US006755673B2

(12) United States Patent
Fukushima et al.

(10) Patent No.: US 6,755,673 B2
(45) Date of Patent: Jun. 29, 2004

(54) LEVER FITTING TYPE POWER SUPPLY CIRCUIT BREAKING APPARATUS

(75) Inventors: Hirotaka Fukushima, Haibara-gun (JP); Yutaka Masuda, Haibara-gun (JP); Satoru Oshita, Haibara-gun (JP); Hidehiko Kuboshima, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/144,809

(22) Filed: May 15, 2002

(65) Prior Publication Data

US 2002/0173185 A1 Nov. 21, 2002

(30) Foreign Application Priority Data

May 16, 2001 (JP) ..... 2001-146369

(51) Int. Cl.[7] ..... H01K 13/62
(52) U.S. Cl. ..... 439/157; 439/372
(58) Field of Search ..... 439/157, 489, 439/372

(56) References Cited

U.S. PATENT DOCUMENTS 5,443,393 A * 8/1995 Okumura et al. ..... 439/157

FOREIGN PATENT DOCUMENTS

| | | |
|---|---|---|
| JP | 4-351866 | 12/1992 |
| JP | 4-351867 | 12/1992 |
| JP | 10-144186 | 5/1998 |

* cited by examiner

*Primary Examiner*—Ross Gushi
(74) *Attorney, Agent, or Firm*—Sughrue Mion, PLLC

(57) ABSTRACT

A lever fitting type power supply circuit breaking apparatus includes: a first connector provided with a terminal; a second connector provided with a terminal; a lever movably provided on the first connector. In a connector temporary-fitting position, the first connector is fitted to the second connector and the terminal of the first connector is separated from the terminal of the second connector by 0.5 mm or more. In a connector fitting position, the first connector is fitted to the second connector and the terminal of the first connector is electrically connected to the terminal of the second connector. The first and second connector are shifted from the connector temporary-fitting position to the connector fitting position as the lever is shift from a movement start position to a fitting completion position.

4 Claims, 30 Drawing Sheets

LEVER FITTING TYPE POWER SUPPLY CIRCUIT BREAKING APPARATUS

BACKGROUND OF THE INVENTION

The present invention relates to a lever fitting type power supply circuit breaking apparatus capable of attaching one of connector housings to the second connector housing and detaching the one of connector housings from the other by utilizing a cam mechanism to thereby operate a lever with a low operating force.

For example, in an electric vehicle, the capacity of a power supply, which is a battery, is large, as compared with that of a power supply in a gasoline-engine car. Thus, when the maintenance of an electric system of the electric vehicle is performed, a power supply circuit is disconnected by a circuit breaking apparatus. Consequently, the safety of an operation is ensured. Such a related power supply circuit breaking apparatus disclosed in JP-A-10-144186 is illustrated in FIGS. 23 to 30.

As shown in FIGS. 23 to 26, the circuit breaking apparatus 100 comprises an apparatus body 101 and a detachable plug 102 detachably provided in the apparatus body 101. The breaker body 101 has a pair of male terminals 103. One of this pair of male terminals 103 is electrically connected to a load. The other male terminal 103 is electrically connected to a power supply through a fuse 104. A pair of perpendicular guide wall portions 106 each having a cam groove 105 are provided outside the pair of male terminals 103, and 103, respectively.

As illustrated in FIG. 26, a reed switch 107*a* is provided in the apparatus body 101. The continuity or non-continuity state of the power supply circuit is detected according to ON state or OFF state of this reed switch 107*a*. As shown in FIGS. 23 and 26, bolt mounting holes 108 are provided at appropriate places in the apparatus body 101. The apparatus body 101 is fixed to a mounting face (not shown) by bolts (not shown) inserted into these bolt mounting holes 108.

The detachable plug 102 has an operating lever 110, on both side faces of which a pair of cam projections 109 are provided, a plug body 112 rotatably provided on this operating lever 110 through a support shaft 111, and a pair of female terminals 114, and 114 connected by a bus bar 113 to each other. Magnets 107*b* are embedded at laterally symmetrical places in the operating lever 110.

When an operator grasps the operating lever 110 of the detachable plug 102 and adjusts the pair of cam projections 109 and 109 to a pair of cam grooves 105, and 105 and then inserts the projections 109 and 109 from a position, which is indicated by solid lines in FIG. 25, into the grooves 105, and 105, respectively, in a position indicated by phantom lines in this figure, the male terminals 103 are inserted into the female terminals 114 and 114 in an insertion stroke of the detachable plug 102. As illustrated in FIG. 24, the pair of male terminals 103, and 103 are electrically connected to each other through the pair of female terminals 114, and 114, and the bus bar 113. Thus, the power supply circuit is brought into a continuity state. After the detachable plug 102 is inserted into the apparatus body 101, the operating lever 110 is rotated with respect to the plug body 112 from the position indicated by the phantom lines in FIG. 25 to the position indicated by the solid lines therein. Thus, as illustrated in FIG. 26, the operating lever 110 is pushed over sideways on the apparatus body 101. The magnet 107*b* approaches and faces the reed switch 107*a* just before this operating lever 110 is pushed over sideways. Thus, the reed switch 107*a* is turned on. Consequently, it is electrically detected that the power supply circuit is put into a continuity state.

Further, to put the power circuit into a circuit-broken state, the operating lever 110 having been pushed over sideways is turned until the state of the lever 101 is put into an erect state. Then, the detachable plug 102 attached to the apparatus body 101 is upwardly pulled out therefrom. Then, the pair of female terminals 114 and 114 are detached from the pair of male terminals 103 and 103 in a stroke in which the detachable plug 102 is upwardly pulled out from the apparatus body 101. Thus, the connection between the pair of male terminals 103, and 103 is interrupted. Consequently, the power supply circuit is brought into a broken state.

Next, the circuit conducting operation is described hereinbelow with reference to FIGS. 27 to 30. As illustrated in FIG. 27, when each of the cam projections 109 of the operating lever 110 is adjusted to the corresponding cam groove 105, and the detachable plug 102 is inserted into the apparatus body 101, an operator sometimes turns the operating lever 110 according to the misunderstanding that the plug 102 is completely inserted into the body 101, though the plug 102 is not quite completely inserted thereinto, as illustrated in FIG. 28. In such a case, as illustrated in FIG. 29, the cam projection 109 rotates together with the operating lever 110 and then abuts against the top face of the cam groove 105. When the operating lever 110 is rotated still more from the position thereof having been in this state, an external force downwardly acts upon the operating lever 110 according to the leverage principle. The detachable plug 102 is gradually inserted thereinto by this external force.

As illustrated in FIG. 30, the detachable plug 102 is inserted into a complete insertion position until the operating lever 110 is positioned at a falling sidelong position. Consequently, both the pair of terminals 103 and 114 are brought into a completely fitted state. Thus, even when the detachable plug 102 is incompletely inserted into the apparatus body 101, both the pair of terminals 103 and 114 can be prevented from being brought into an incompletely fitted state.

However, the related power circuit breaking apparatus 100, both the terminals 103 and 114 are not in a non-contact state until the operating lever 110 is completely detached from the apparatus body 101. When the operating lever 110 is only rotated from a position, in which the operating lever is pushed sidewise, to another position, in which the operating lever 110 is in an erect state, both the terminals 103 and 114 are still in a contact state. In the case that the lever 110 is returned to a rotation start position notwithstanding the contact state of such terminals, and that a maintenance operation is performed according to the misunderstanding that both the terminals 103 and 114 are in a noncontact state, the safety of operators is not secured. Further, in the power supply breaking apparatus 100, when the operating lever 110 is returned from the position, in which the operating lever 110 is pushed sidewise, to the position, in which the operating lever 110 is in the erect state, the reed switch 107*a* is turned off. Thus, owing to the turn-off of the reed switch 107*a*, there is a fear that an operator may misunderstand that both the terminals 103 and 114 are in a noncontact state.

Meanwhile, there have been various kinds of low-voltage small-current connectors adapted to put both terminals into a contact state or a non-contact state by operating a lever in such a way as to perform approaching movement and receding movement of each of both connector housings between a connector temporary fitting position and a connector fitting position. However, in the case of such related connectors, the distance between the terminals in the connector temporary fitting position, which is a movement start position, is not taken into consideration. Thus, when such a related low-voltage small-current connector is applied to a high-voltage large-current power circuit breaking apparatus, there is a fear that arc discharge occurs. Thus, the safety of an operation is not ensured.

SUMMARY OF THE INVENTION

Accordingly, the invention is accomplished to solve the aforementioned problems, and an object of the invention is to provide a lever-fitting type power supply circuit breaking apparatus adapted to bring terminals of both connector housings, which are placed at a connector temporary fitting position of both connector housings, into a non-continuity state to thereby reliably prevent an occurrence of arc discharge and to thereby ensure the safety of an operator.

In order to solve the aforesaid object, the invention is characterized by having the following arrangement.

(1) A lever fitting type power supply circuit breaking apparatus comprising:

a first connector provided with a terminal;

a second connector provided with a terminal;

a lever movably provided on the first connector;

a cam groove provided on one of the lever and the second connector; and a cam pin provided on the other of the lever and the second connector and adapted to be engaged with the cam groove, wherein in a connector temporary-fitting position, the first connector is fitted to the second connector and the terminal of the first connector is separated from the terminal of the second connector by 0.5 mm or more, in a connector fitting position, the first connector is fitted to the second connector and the terminal of the first connector is electrically connected to the terminal of the second connector, and wherein the cam pin is moved along and guided by the cam groove so as to shift the first and second connector from the connector temporary-fitting position to the connector fitting position as the lever is shift from a movement start position to a fitting completion position.

(2) The lever fitting type power supply circuit breaking apparatus according to (1), wherein the lever performs rotational movement between the movement start position in which the terminals of the first and second connectors are separated from each other and a rotation completion position in which the terminals of the first and second connectors are brought in electrical contact with each other, and rectilinear movement between the rotation completion position in which a fitting detection switch is in off state and the fitting completion position in which the fitting detection switch is in on state, and a power supply circuit is connected in series to a relay circuit which is turned on and off by the fitting detection switch, and a power switch comprising the terminals of the first and second connector housings.

In this lever fitting type power supply circuit breaking apparatus, during both the connectors are placed at a connector temporary-fitting position, the terminals of both the connector housings are disposed by putting a certain distance therebetween, which is sufficient for preventing an occurrence of arc discharge. Consequently, an occurrence of arc discharge between the terminals of both the connector housings is reliably prevented. Thus, the safety of an operator is ensured.

In the case of the second lever fitting type power supply circuit breaking apparatus, even when a failure of the power supply circuit (or electric circuit) is caused and the relay circuit is not normally turned off by breakdowns of the fitting detection switch and the relay circuit in an operating process in which the lever rectilinearly moves from the fitting completion position to the rotation completion position, an occurrence of arc discharge between the terminals of both the connector housings is reliably prevented because the terminals of both the connector housings are separated away by a certain distance therebetween, which is sufficient for preventing an occurrence of arc discharge, during both the connector housings are placed at the connector temporary-fitting position. That is, the power supply circuit is interrupted only by operating the lever. Thus, the safety of an operator is ensured.

BRIEF DESCRIPTION OF THE DRAWINGS

FIG. 1A is an exploded front view of a first connector housing. FIG. 1B is an exploded side view of the first connector housing.

FIG. 3A is a side view of the lever. FIG. 3B is a sectional view taken along line A—A of FIG. 3A.

FIG. 6A is a partly cutaway plan view of the one, to which the lever placed at the rotation start position is attached, of the first connector housing. FIG. 6B is a bottom view of the one, to which the lever placed at the rotation start position is attached, of the first connector housing.

FIG. 8A is a plan view of the other connector. FIG. 8B is a sectional view taken along line B—B of FIG. 8A.

FIG. 16A illustrates a process of movement of a cam pin when the first connector housing is attached to the second connector housing, and is a front view illustrating a state in which the lever is placed between the rotation start position and the rotation completion position. FIG. 16B illustrates the process of movement of the cam pin when the first connector housing is attached to the second connector housing, and is a front view illustrating a state in which the lever is placed at the rotation completion position. FIG. 16C illustrates the process of movement of the cam pin when the first connector housing is attached to the second connector housing, and is a front view illustrating a state in which the lever is placed at a fitting completion position.

FIG. 17A illustrates a process of movement of a lever locus correction guide pin when the first connector housing is attached to the second connector housing, and is a front view illustrating a state in which the lever is placed between the rotation start position and the rotation completion position. FIG. 17B illustrates the process of movement of the lever locus correction guide pin when the first connector housing is attached to the second connector housing, and is a front view illustrating a state in which the lever is placed at the rotation completion position. FIG. 17C illustrates the process of movement of the lever locus correction guide pin when the first connector housing is attached to the second connector housing, and is a front view illustrating a state in which the lever is placed at the fitting completion position.

FIG. 18A is a plan view illustrating a state in which the attachment of the first connector housing to the second connector housing is completed. FIG. 18B is a front view illustrating a state in which the attachment of the first connector housing to the second housing connector is completed.

FIG. 22A is a sectional view illustrating that a plug rotating tool cannot be attached to a bolt during the first connector housing is attached to the second connector housing. FIG. 22B is a sectional view illustrating a state in which the first connector housing is detached from the second connector housing and in which the bolt rotating tool is attached to the bolt.

DETAILED DESCRIPTION OF PREFERRED EMBODIMENTS

Hereinafter, an embodiment of the invention is described with reference to the accompanying drawings.

Figure 1A:
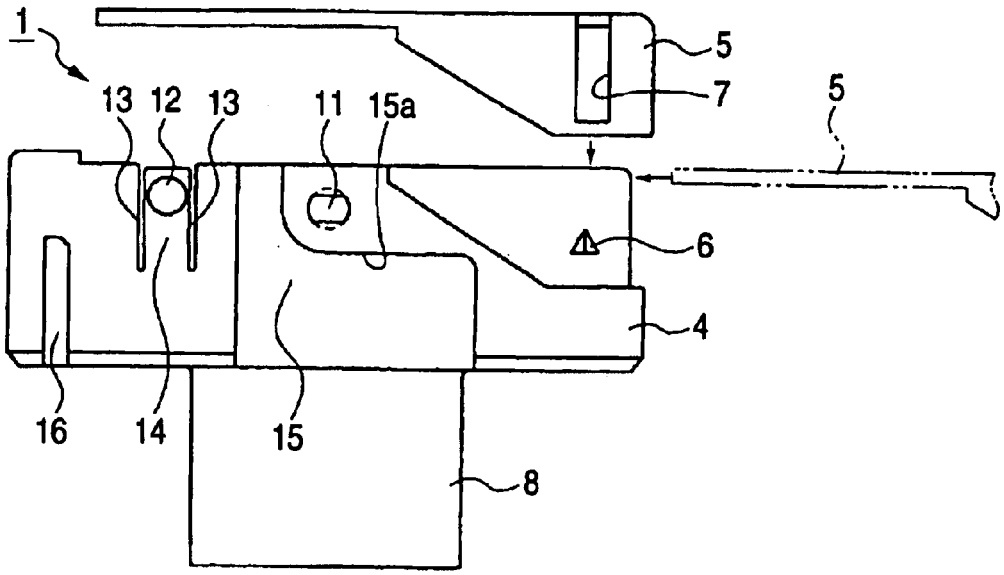
FIGS. 1A and 1B illustrate an embodiment of the invention.
Figure 1B:
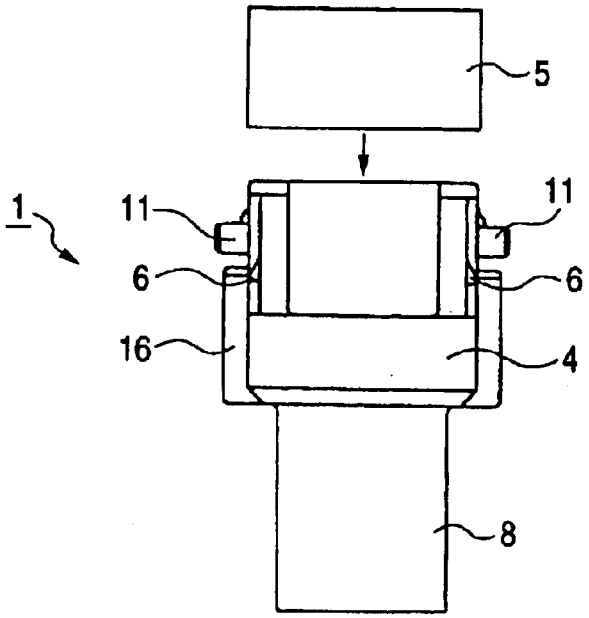
Figure 2:
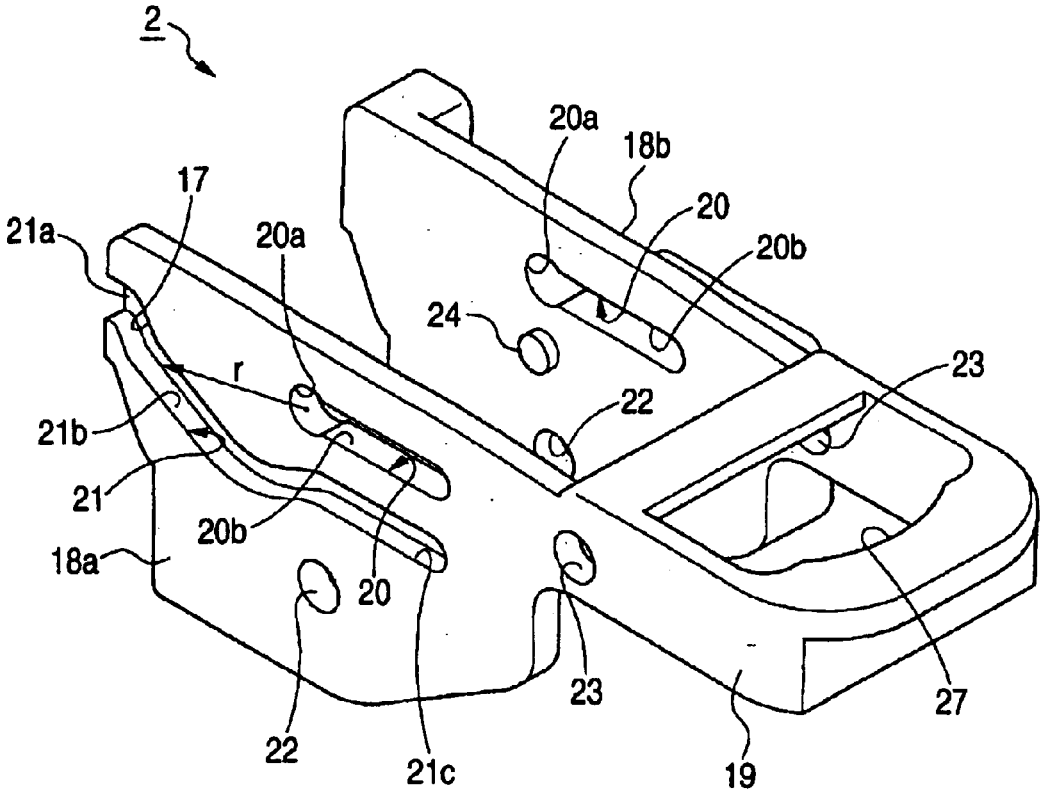
FIG. 2 illustrates the embodiment of the invention and is a perspective view of a lever.
Figure 3A:
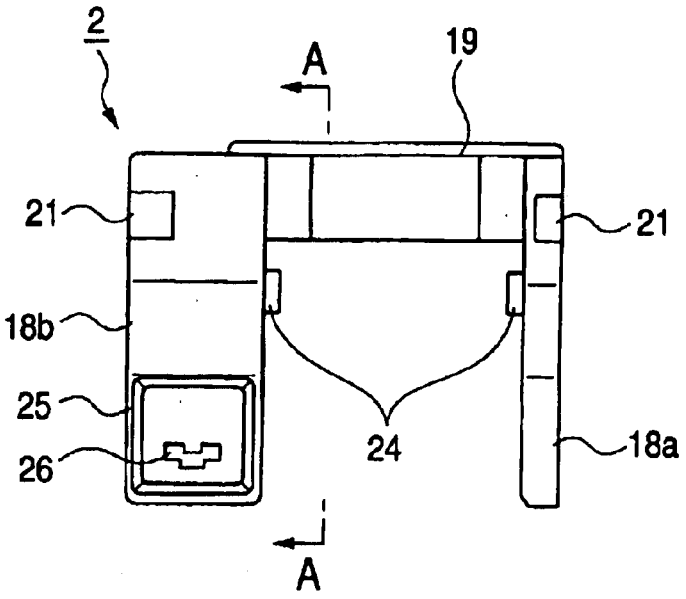
FIGS. 3A and 3B illustrate the embodiment of the invention.
Figure 3B:
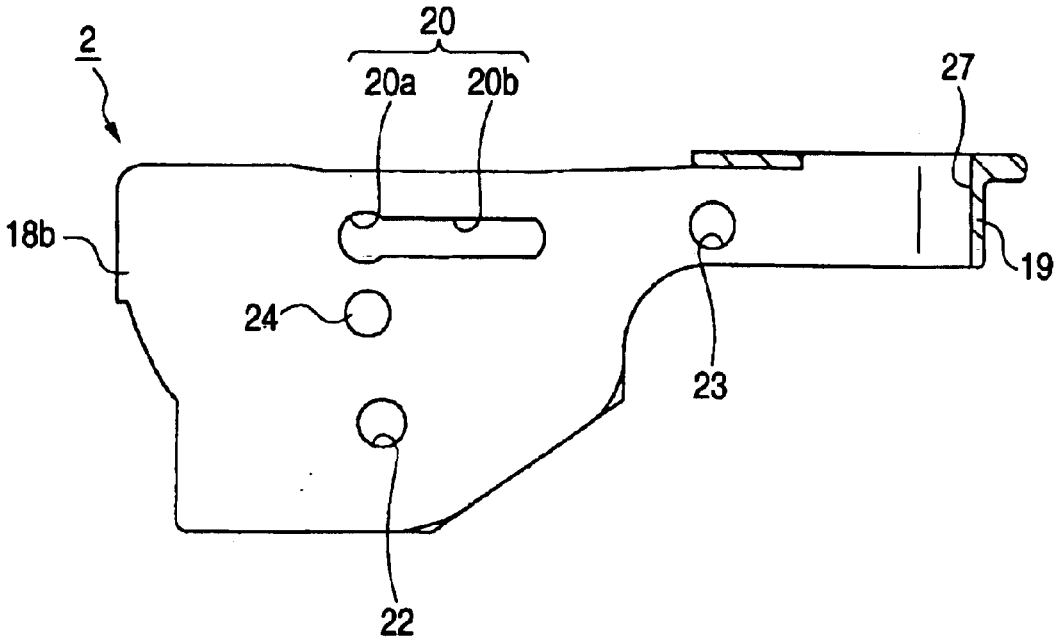
Figure 4:
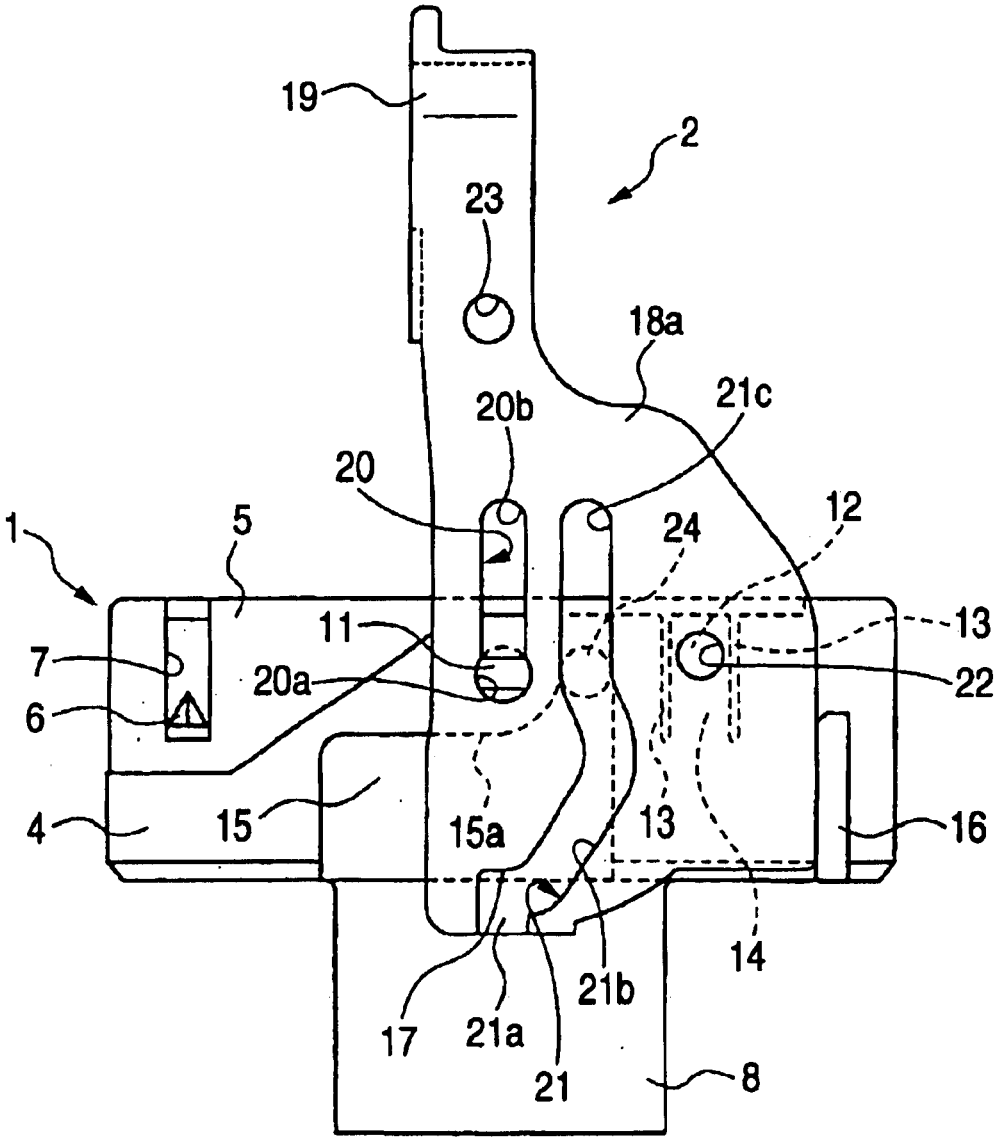
FIG. 4 illustrates the embodiment of the invention and is a front view of the one, to which the lever placed at a rotation start position is attached, of the first connector housing that is in a state in which the lever is placed at a rotation start position.
Figure 5:
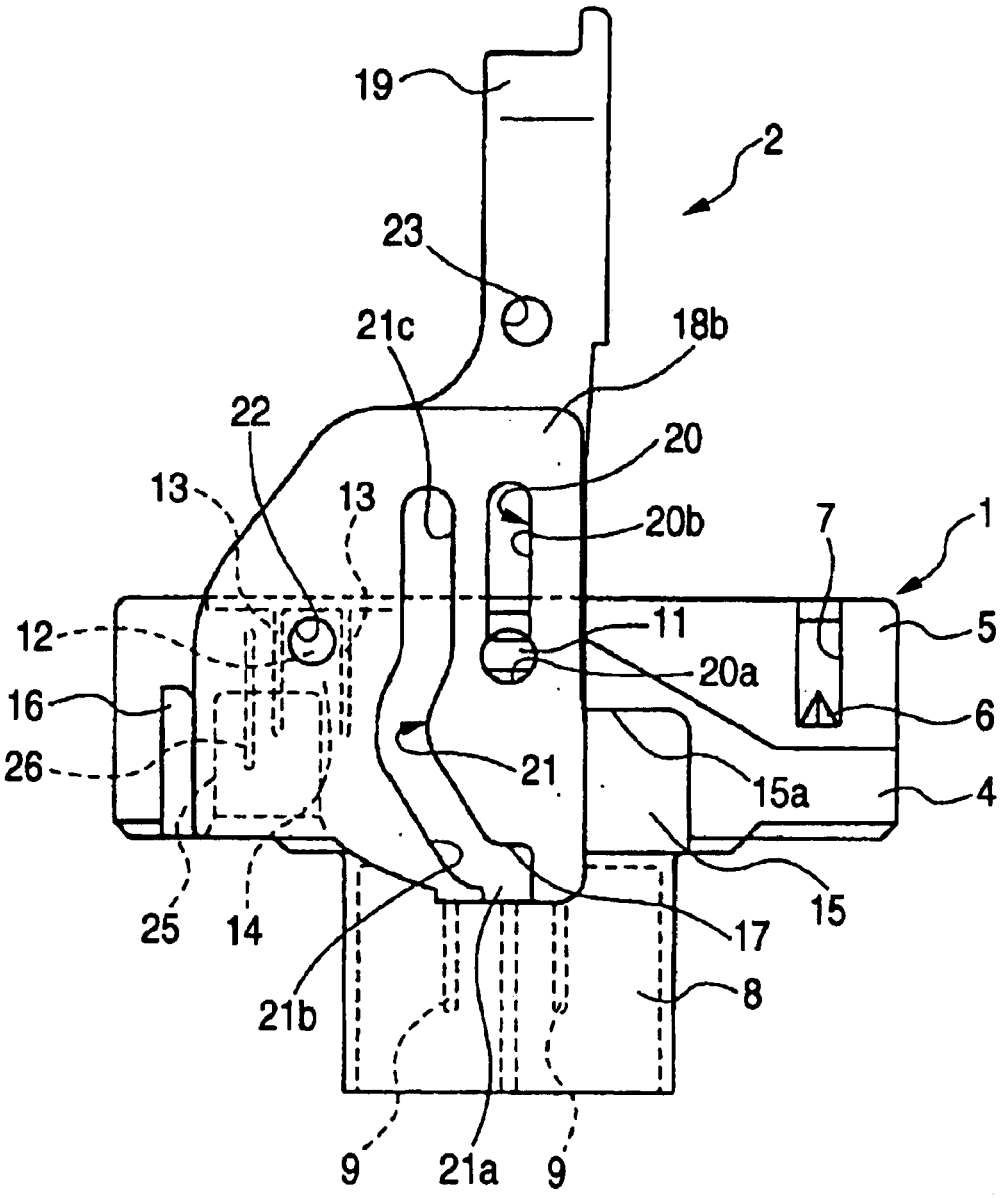
FIG. 5 illustrates the embodiment of the invention and is a rear view of the one, to which the lever placed at the rotation start position is attached, of the first connector housing that is in the state in which the lever is placed at the rotation start position.
Figure 6A:
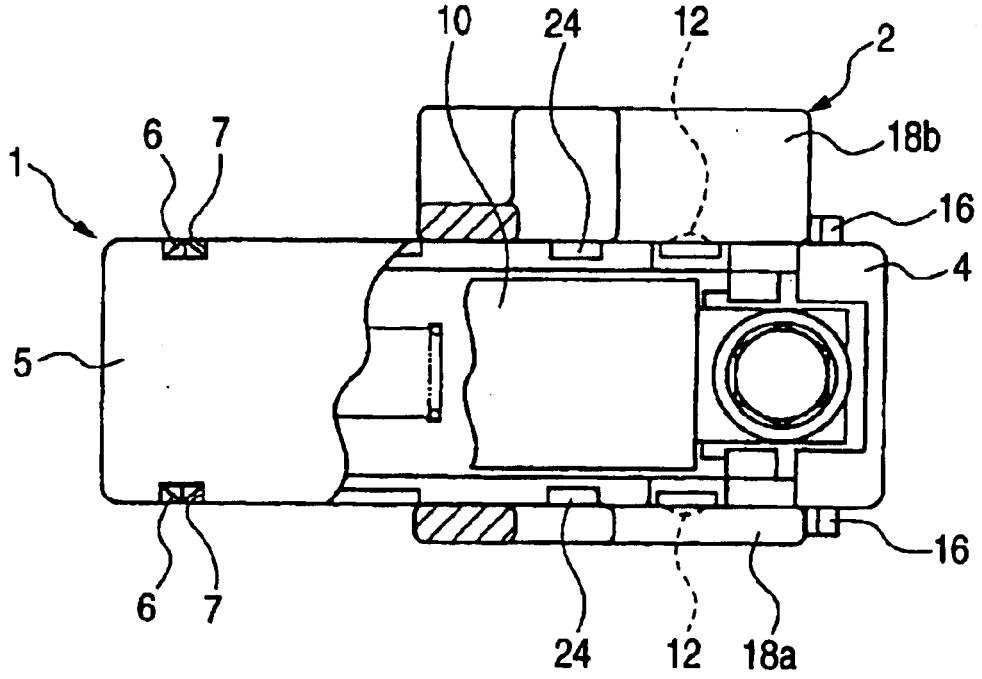
FIGS. 6A and 6B illustrate the embodiment of the invention.
Figure 6B:
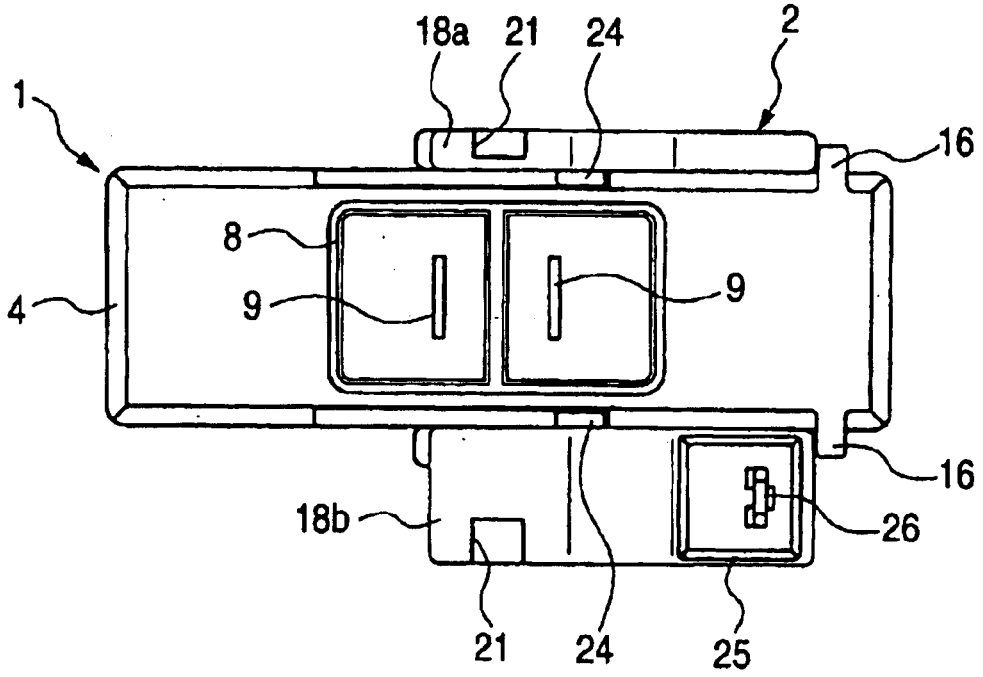
Figure 7:
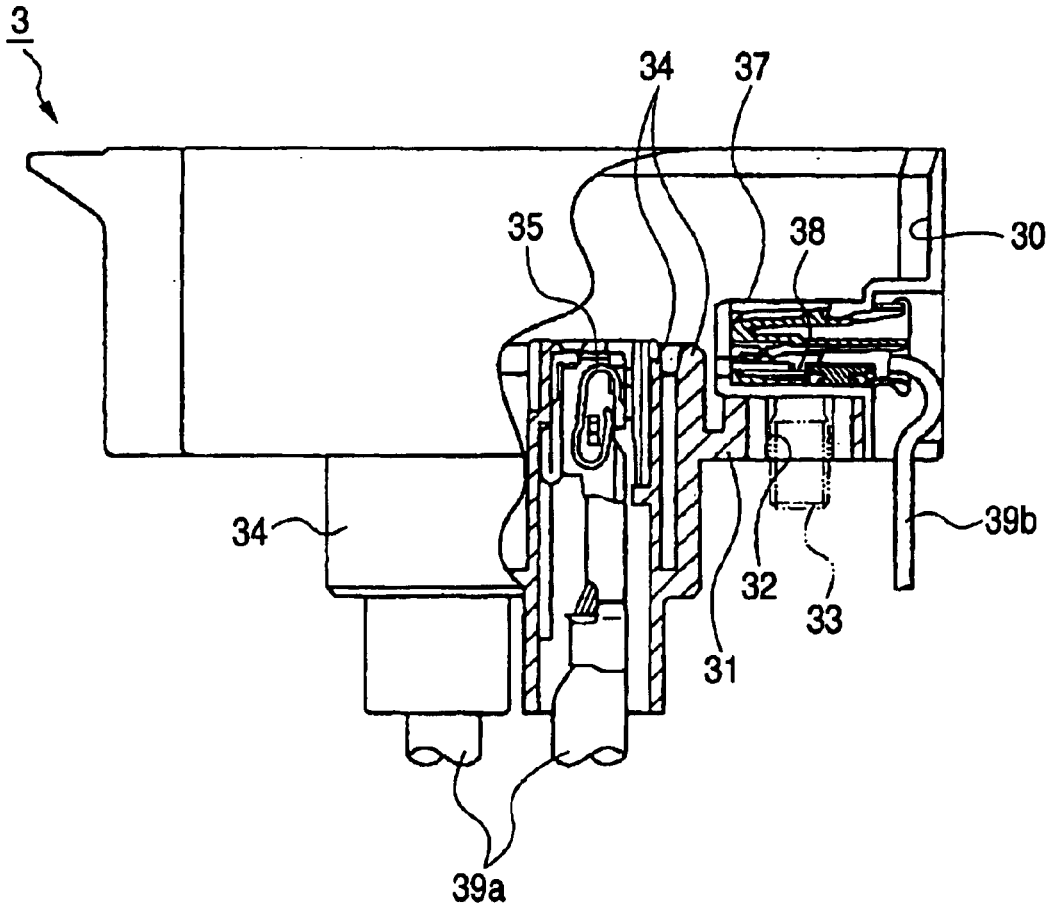
FIG. 7 illustrates the embodiment of the invention and is a partly cutaway front view of a second connector housing.
Figure 8A:
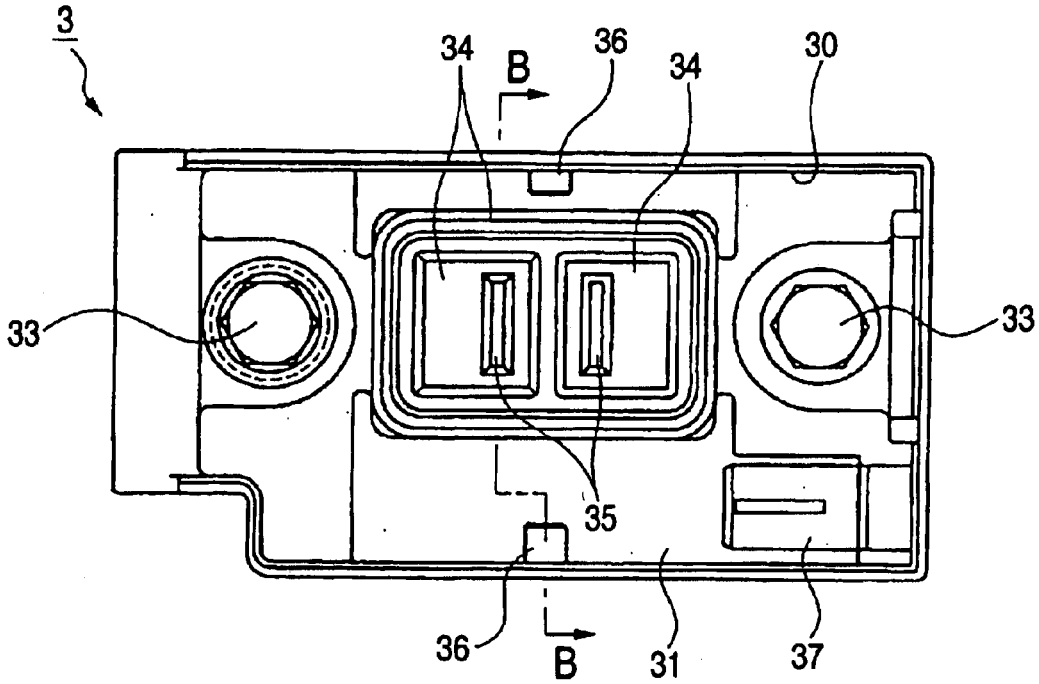
FIGS. 8A and 8B illustrate the embodiment of the invention.
Figure 8B:
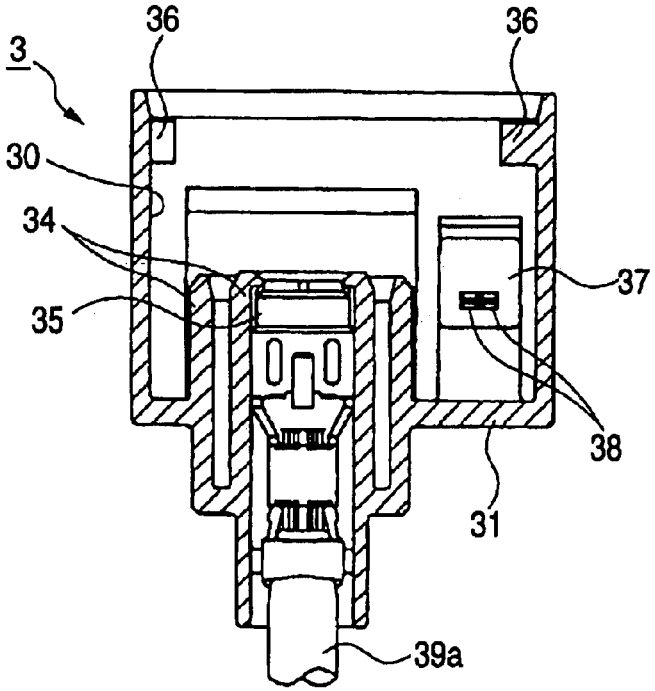

FIGS. 1A to 22B illustrate a lever fitting type power supply circuit breaking apparatus that is an embodiment of the invention. FIG. 1A is an exploded front view of a first connector housing. FIG. 1B is an exploded side view of the first connector housing. FIG. 2 is a perspective view of the lever. FIG. 3A is a side view of the lever. FIG. 3B is a sectional view taken along line A—A of FIG. 3A. FIG. 4 is a front view of the first connector housings, which has the lever attached thereto and is in a state in which the lever is placed at a rotation start position. FIG. 5 is a rear view of the one, to which the lever placed at the rotation start position is attached, of the first connector housing that is in the state in which the lever is placed at the rotation start position. FIG. 6A is a partly cutaway plan view of the one, to which the lever placed at the rotation start position is attached, of the first connector housing. FIG. 6B is a bottom view of the one, to which the lever placed at the rotation start position is attached, of the first connector housing. FIG. 7 illustrates the embodiment of the invention and is a partly cutaway front view of the second connector housing. FIG. 8A is a plan view of the other connector. FIG. 8B is a sectional view taken along line B—B of FIG. 8A.

As illustrated in FIGS. 10 to 15 and FIGS. 18A to 22B, the lever-fitting type power supply circuit 1A for a high-voltage large-current circuit includes a first connector housing 1 made of synthetic resin, a lever 2, which is attached to the first connector housing 1 and made of synthetic resin, and a second connector housing 3 made of synthetic resin, to which the one of the connector housing 1 is attached by operating this lever 2.

As illustrated in FIGS. 1A and 1B, and 4 to 6B, the first connector housing 1 includes a housing body 4 and a cover 5 attached thereto in such a manner as to cover the top surface of the housing body 4. The cover 5 is attached to the housing body 4 by inserting a pair of triangular-pyramid-like projections 6 of the housing body 4 into locking holes 7, respectively. Each of the triangular-pyramid-like projections 6 is provided in such a way as to have a base surface, which is perpendicular to a surface of the housing body 4, and lateral surfaces, which are slants each gradually rising from the surface of the housing body 4. Thus, the cover 5 can be attached to the housing body 4 from both above and side, as indicated by solid lines and phantom lines in FIG. 1A. Therefore, in the case that the lever fitting type power supply circuit breaking apparatus 1A is installed in a narrow space, the cover 5 can easily be attached thereto and removed therefrom.

A terminal hood portion 8 is provided under the housing body 4. A pair of male terminals (terminals) 9 illustrated in FIGS. 5 and 6B are provided in this terminal hood portion 8 in such a way as to project downwardly. The pair of male terminals 9 are electrically connected to a fuse 10 (shown in FIGS. 6A and 21) housed in the housing body 4.

A pair of guide pins 11 are provided on the outer wall of the housing body 3 in such a manner as to protrude therefrom. Each of the guide pins 11 is shaped like a cylinder, whose top and bottom portions are cut, so that the cylinder has a nearly elliptic transverse section. That is, each of the guide pins 11 comprises a major-width portion and a minor-width portion. The pair of guide pins 11 are engaged with guide grooves 20 (to be described later) of the lever 2, respectively.

Nearly semispherical pair of locking projections (convex portions) 12 are provided on the outer wall of the housing body 4 in such a way as to protrude therefrom. Each of the locking projections 12 is provided on a flexible arm portion 14 formed between a pair of slits 13 in the outer wall of the housing body 4. The pair of locking projections 12 holds the lever 2 at a predetermined position by being inserted into a first locking hole 22 and a second locking hole 23 (to be described later) of the lever 2, and are easily displaced to the inside of the housing body 4 owing to elastic deflection and deformation of the flexible arm portion 14. A pair of lever locus correction guide grooves 15 are provided in the outer wall of the housing body 4. One of side surfaces 15*a* of a step-like-portion, which constitute each of the lever locus correction guide grooves 15, is constituted by a perpendicular step side surface, which extends in upward and downward directions, a horizontal step side surface, which extends in a horizontal direction, and an arcuate step side surface, which connects the perpendicular step side surface and the horizontal step side surface in such a way as to form an arcuate surface. A pair of lever locus correction guide pins 24 (to be described later) of the second connector housing 3 are engaged with the pair of lever locus correction guide grooves 15. The pair of lever locus correction guide pins 24 are adapted to slide along the step side surface 15*a* of the lever locus correction guide groove 15.

A pair of lever rotation stopper portions 16 and 16 are provided on the housing body 4 in such a way as to project therefrom. The pair of lever rotation stopper portions 16 and 16 regulate the rotation of the lever 2 so that the lever 2 can rotate only between the rotation start position of FIGS. 10 and 11, at which the lever 2 is in an erect state in the first connector housing 1, and the rotation completion position of FIG. 14, in which the lever 2 is parallel to the first connector housing 1.

As illustrated in FIGS. 2 to 6B, the lever 2 includes a pair of arm plate portions 18*a* and 18*b* which are disposed at a certain distance in parallel to each other, and an operating portion 19 for connecting this pair of arm plate portions 18*a* and 18*b* to each other. In the pair of arm plate portions 18*a* and 18*b*, guide grooves 20 extending in a horizontal direction are provided at symmetrical positions. The pair of guide pins 11 of the first connector housing 1 are inserted into the guide grooves 20, respectively. Each of the guide grooves 20 includes a one-end-side arc-like arcuate portion 20*a* and a linear straight portion 20*b*communicating with this arcuate portion 20*a*. These portions 20*a* and 20*b* are provided so that the diameter of this arcuate portion 20*a* is slightly larger than that of an arcuate part (that is, a part having a major width) of the guide pin 11, and that the width of the straight portion 20*b* is slightly larger than that of the cut part (that is, a part having a minor width). The lever 2 is adapted so that at rotation positions other than the rotation completion position shown in FIG. 14, the guide pins 11 can be disposed only at the arcuate portions 20*a* of the guide grooves 20, and the lever 2 is permitted to perform rotation movement between the rotation start position (that is, the movement start position) shown in FIGS. 10 and 11 and the rotation completion position shown in FIG. 14, and that at the rotation completion position shown in FIG. 14 (that is, the fitting completion position shown in FIG. 15), each of the guide pins 11 is permitted to perform sliding movement from a corresponding one of the arcuate portions 20*a* of the guide grooves 20 to a corresponding one of the straight portions 20*b*, and the lever 2 is allowed to perform rectilinear movement by sliding between the rotation completion position shown in FIG. 14 and the fitting completion position shown in FIG. 15. As described hereinabove, the lever 2 is provided in such a manner as to be able to perform rotating movement and rectilinear movement with respect to the one of the connector housing 1.

The cam grooves 21 are provided at the symmetrical positions in the pair of the arm plate portions 18*a* and 18*b*. When the first connector housing 1 is attached to the second connector housing 3, the cam pins 36 (to be described later) of the second connector housing 3 are respectively inserted into the pair of the cam grooves 21. Each of the cam grooves 21 has an opening portion 21*a*, whose one end is opened to a corresponding one of the end surfaces of the arm plate portions 18*a* and 18*b*, a bent portion 21*b*, which is adapted so that the distance r from the arcuate portion 20*a* of the guide groove 20 to a position therein gradually decreases as the position therein becomes deeper in the bent portion 21*b* from this opening portion 21*a*, and the straight portion 21*c* that is placed in parallel to a corresponding one of the straight portions 20*b* of the guide grooves 20.

Figure 10:
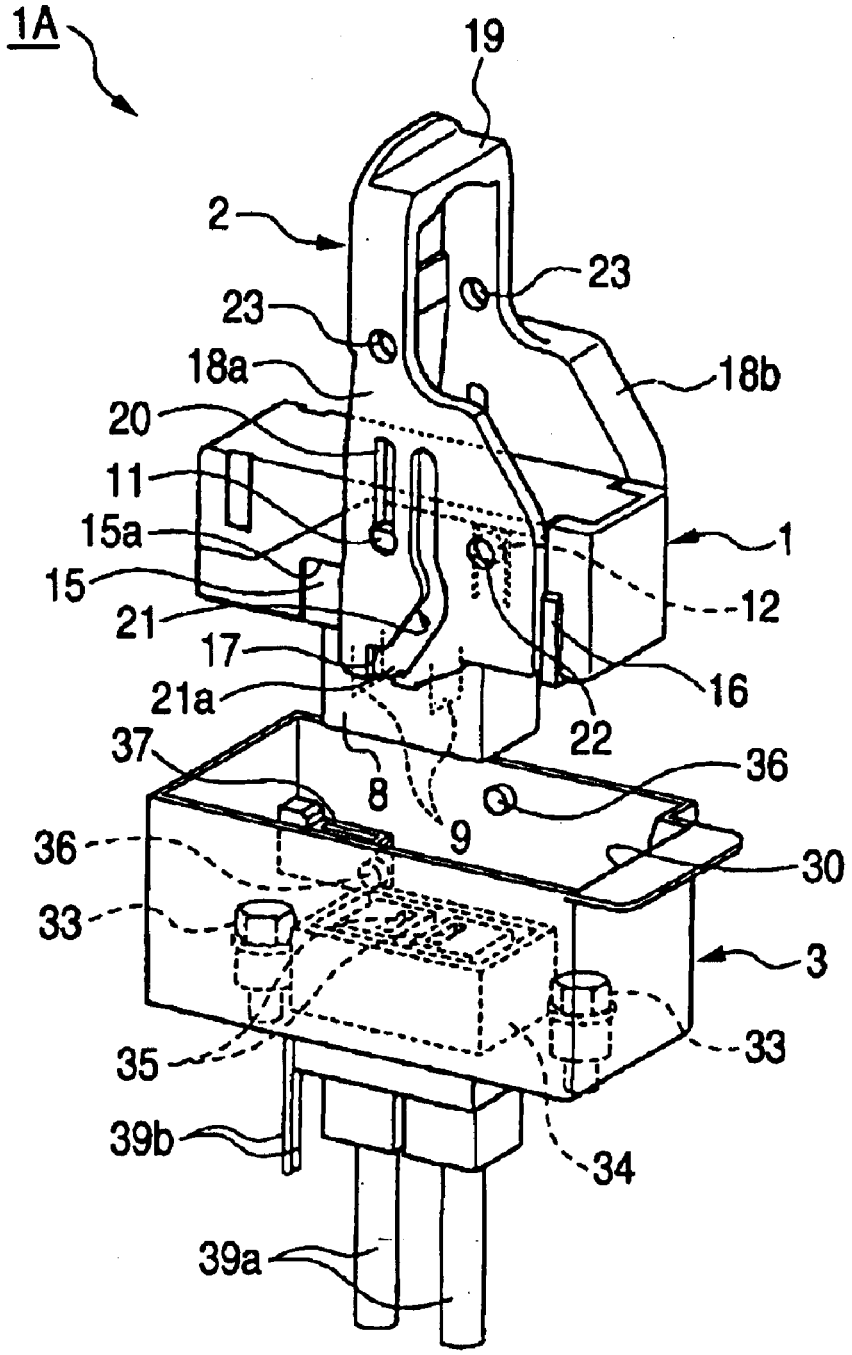
FIG. 10 illustrates the embodiment of the invention and is a perspective view showing a state in which the first connector housing is not attached to the second connector housing yet.
Figure 11:
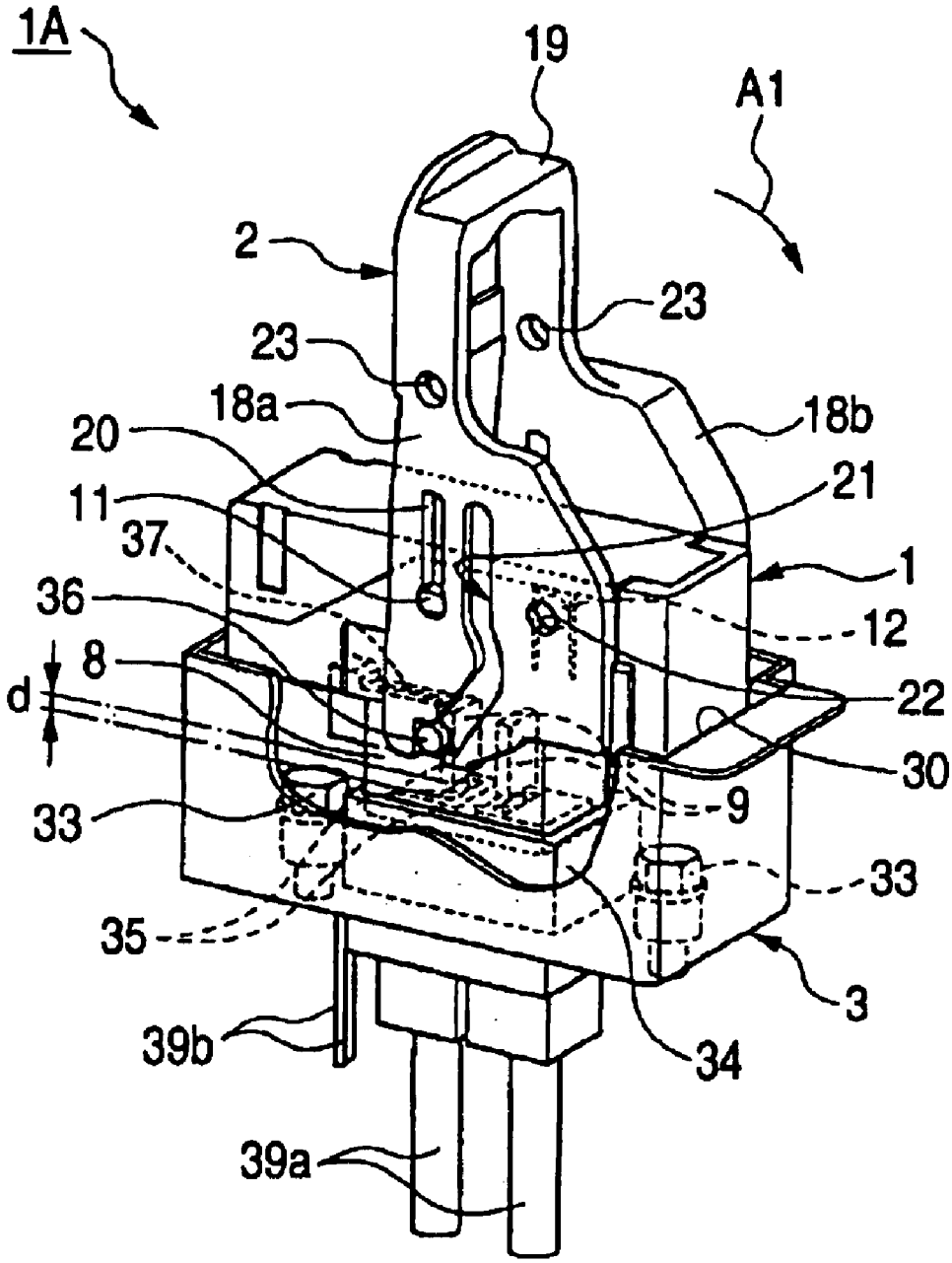
FIG. 11 illustrates the embodiment of the invention and is a perspective view showing a state in which the first and second connector housings are placed at a connector temporary-fitting position in a process of attaching the first connector housing to the second connector and in which the lever is placed at a rotation start position.
Figure 12:
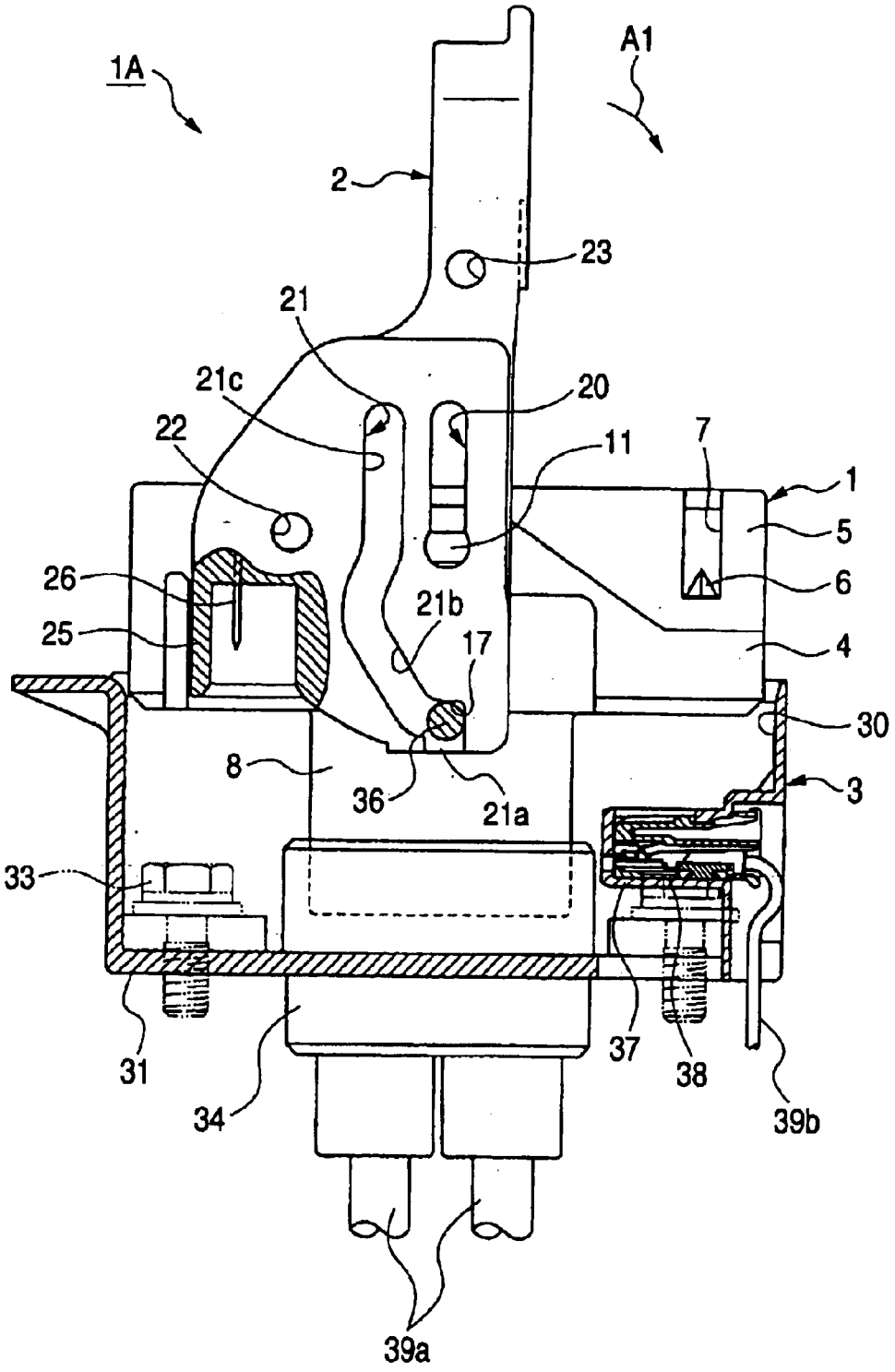
FIG. 12 illustrates the embodiment of the invention and is a partly broken front view showing a state in which the first and second connector housings are placed at a connector temporary-fitting position in a process of attaching the first connector housing to the second connector and in which the lever is placed at a rotation start position.

The upper side wall surface of each of the opening portions 21*a* is formed as a side wall stopper surface 17. In case that the lever 2 is put into an erect state as shown in FIG. 10, and the first and second connector housings are placed at the connector temporary-fitting position by inserting the first connector housing 1 into the second connector housing 3 without using the lever 2, the corresponding cam pin 36 abuts against the side wall stopper surface 17 as shown in FIGS. 11 and 12. That is, the cam pin 36 is prevented from being inserted deeper thereinto. Thereafter, the first connectors can be inserted thereinto only by operating the lever 2.

The first locking holes (or concave portion) 22 and the second locking holes (or concave portion) 23 are provided at the symmetrical positions in the pair of arm plate portions 18*a* and 18*b*, respectively. The locking projections 12 of the first connector housing 1 are adapted to be inserted into the first locking holes 22 and the second locking holes 23, respectively. At the rotation start position (that is, the movement start position) in which the lever 2 is in an erect state in the first connector housing 1, the locking projection 12 is inserted into the first locking hole 22, so that the lever 2 is held at the rotation start position (that is, the movement start position). At the fitting completion position in which the lever 2 is parallel to the first connector housing 1, the locking projection 12 is inserted into the second locking hole 23, so that the lever 2 is held at the fitting completion position. Incidentally, the rotation completion position of the lever 2 is a position in which the lever 2 is located halfway in the operation, so that the locking projections 12 are not locked.

A pair of lever locus correction guide pins 24 are provided on the inner walls of the pair of arm plate portions 18*a* and 18*b*, respectively. The pair of lever locus correction guide pins 24 are engaged with the pair of lever locus correction guide grooves 15, respectively. One of the pair of plate portions 18*a* and 18*b* is provided so that the width thereof is wider than the width of the other plate portion. A connector portion 25 shown in FIGS. 3A and 5 is provided in this wide arm plate portion 18*b*. This connector portion 25 has a fitting detection male terminal 26 serving as a fitting detection terminal. A finger insertion hole 27 is provided in the operating portion 19 in such a manner as to have a certain size set to the extent that a single finger of a person can be inserted thereinto with difficulty.

Figure 21:
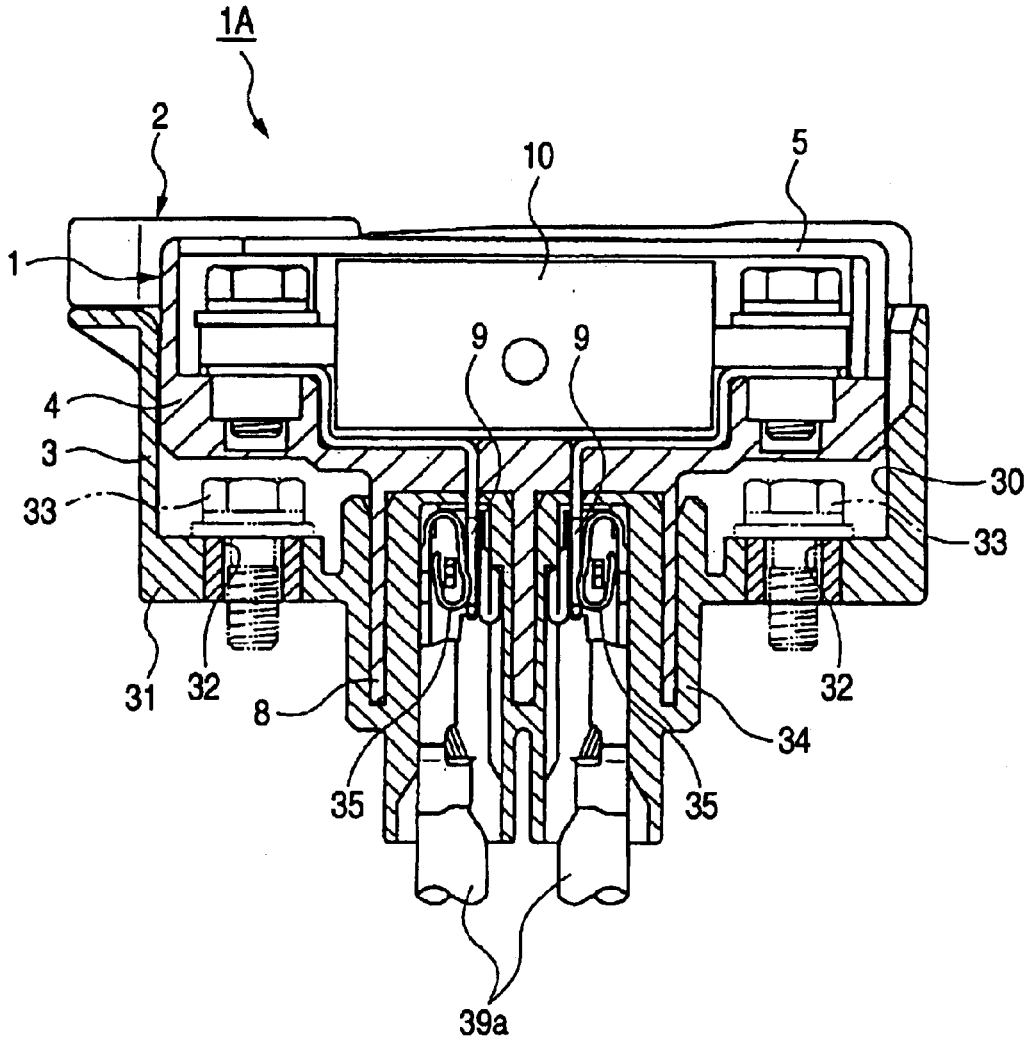
FIG. 21 illustrates the embodiment of the invention and is a sectional view taken along line C—C of FIG. 18A.

As illustrated in FIGS. 7 and 8, the second connector housing 3 has a nearly rectangular-prism-like shape opened in the top portion thereof. The inner space thereof is a space 30 for attaching the one of the connector housing 1. Bolt insertion holes 32 shown in FIGS. 21 and 22 are formed in the bottom surface portions 31 each including the bottom surface of this mounting space 30. The second connector housing 3 is fixed to a desired mounting surface (not shown) by bolts 33 inserted into the bolt insertion holes 32.

Further, a terminal hood accommodating portion 34 is provided in the bottom surface portion 31 including the bottom surface of the mounting space 30 in such a way as to be integral therewith and as to upwardly or downwardly project therefrom. A Pair of female terminals (or terminals) 35 and 35 shown in FIGS. 5 and 6B are accommodated in the terminal hood accommodating portions 34. When the first connector housing 1 performs approaching movement to downwardly approach the second connector housing 3 from thereabove, the pair of male terminals 9 and 9 of the first connector housing 1 come into the terminal hood accommodating portion 34 and then are brought into contact with the pair of female terminals 35 and 35. Further, when the terminals 9 and 35 are in a contact state and the one of the connector housing 1 performs receding movement to upwardly go away from the second connector housing 3, the pair of male terminals 9 and 9 recede from the terminal hood accommodating portion 34 and thus become out of contact with the pair of female terminals 35 and 35. Furthermore, at the connector temporary-fitting position shown in FIGS. 11 to 13, the distance (or gap) d between the terminals 9 and the terminals 35 of both the first and second connector housings 1 and 3 is set to be 1.4 mm. That is, at the connector temporary-fitting position shown in FIGS. 11 to 13, the distance d between the terminals 9 and the terminals 35 is set so that the terminals 9 are apart from the terminals 35 by 1.4 mm.

Figure 9:
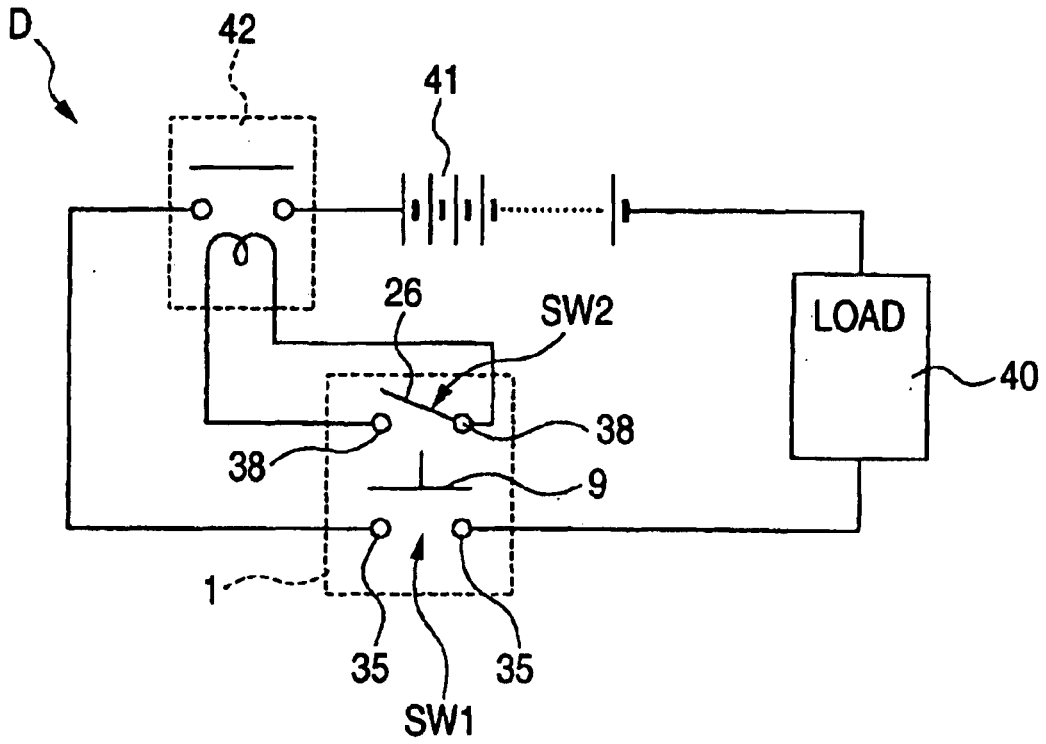
FIG. 9 illustrates the embodiment of the invention and is a circuit view of a power supply circuit.

Further, one end of a lead wire 39*a* is connected to each of the female terminals 35. One end of the lead wire 39*a* is led to a load portion 40 of the power supply circuit D, and the other end thereof is led to a power supply portion 41 thereof. That is, as illustrated in FIG. 9, the power switch SW1 of the power supply circuit D consists of the male terminals 9 and the female terminals 35 of both the first and second connector housings 1 and 3.

Furthermore, the pair of cam pins 36 and 36 are provided at the symmetrical positions on the inner wall of the second connector housing 3 in such a way as to project therefrom. The pair of cam pins 36 and 36 are inserted into the cam groove 21 of the lever 2 when the one of the connector housing 1 is attached to the second connector housing 3. Further, the connector portion 37 is provided in the mounting space 30 in the second connector housing 3. A Pair of fitting detection female terminals 38 and 38 serving as the fitting detection terminals are disposed in a connector portion 37. A fitting detection switch SW2 is constituted by this pair of the fitting detection terminals 38 and 38 and the pair of fitting detection male terminals 26 and 26 of the lever 2. This fitting detection switch SW2 is turned on by bringing the pair of fitting detection male terminals 26 and 26 into contact with the fitting female terminals 38 and 38. Conversely, the fitting detection switch SW2 is turned off by causing the pair of fitting detection male terminals 26 and 26 to be out of contact with the fitting female terminals 38 and 38. Lead wires 39*b* are connected to the pair of female terminals 38 and 38, respectively. Both the lead wires 39*b* are led to a relay circuit 42 of the power supply circuit D.

Next, the power supply circuit D is described hereinbelow. As illustrated in FIG. 9, the power supply circuit D has a load portion 40 and a power supply portion 41 for supplying electric power to this load portion 40. The power switch SW1 consisting of the terminals 9 and 35 of both the first and second connector housings 1 and 3, and the relay circuit 42 are connected in series to the load portion 40 and the power supply portion 41. The relay circuit 42 is turned on when the fitting detection switch SW2 is in an ON-state, while the relay circuit 42 is turned off when the fitting detection switch SW1 is in an OFF-state. As above described, the power switch SW1 consisting of the terminals 9 and 35 of both the first and second connector housings 1 and 3 is a mechanical switch.

Figure 13:
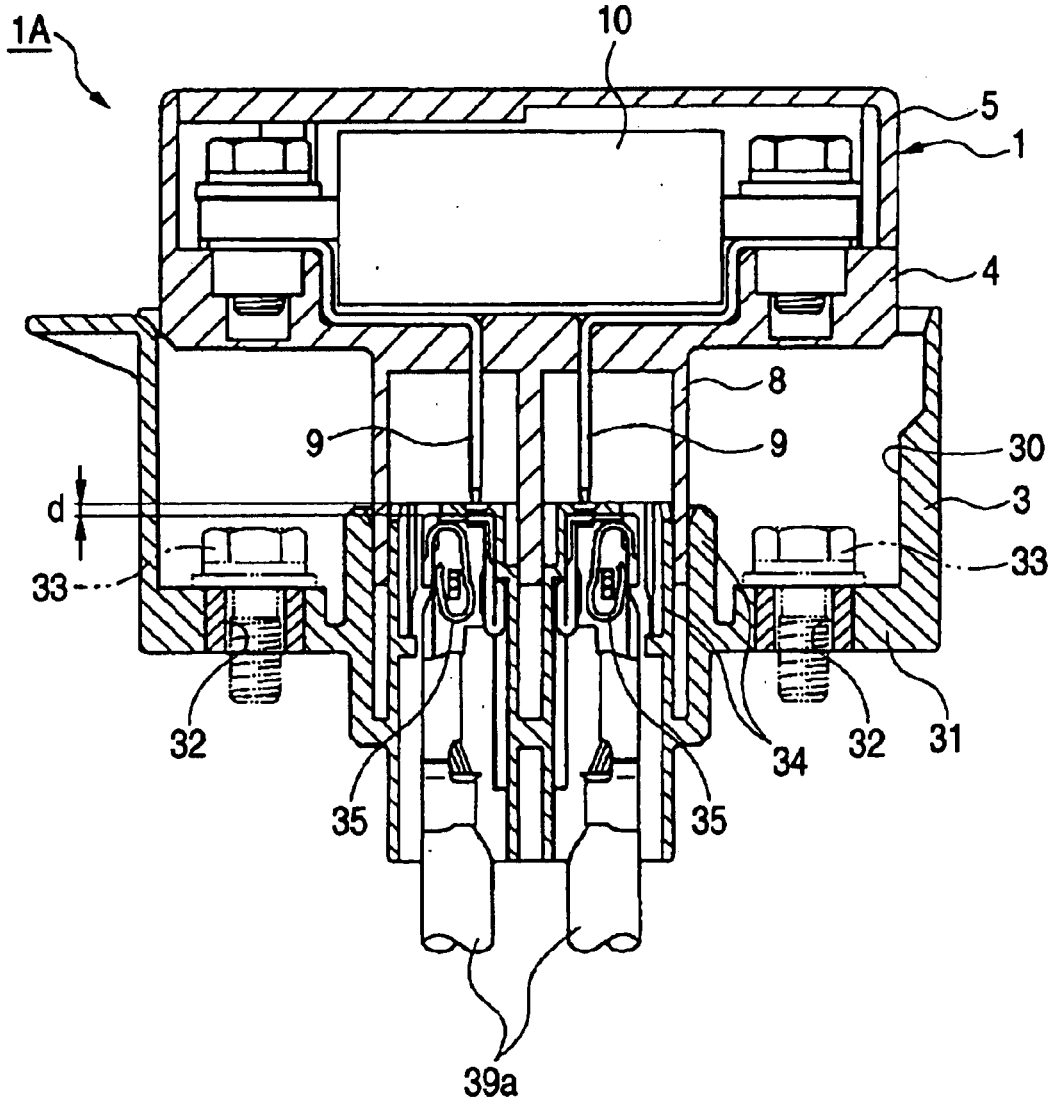
FIG. 13 illustrates the embodiment of the invention and is a sectional view showing a state in which the first and second connector housings are placed at a connector temporary-fitting position in a process of attaching the first connector housing to the second connector by omitting the lever placed at a rotation start position.
Figure 14:
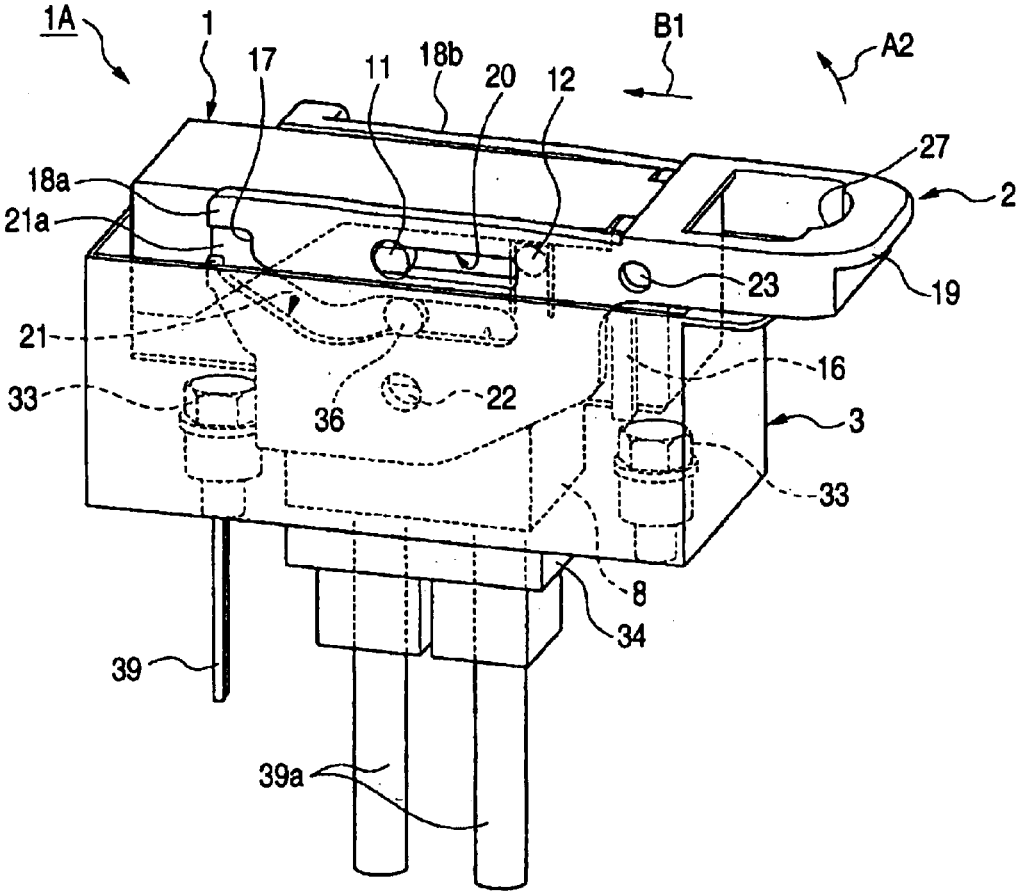
FIG. 14 illustrates the embodiment of the invention and is a perspective view showing a state in which the first and second connector housings are placed at a connector temporary-fitting position in a process of attaching the first connector housing to the second connector and in which the lever is placed at a rotation completion position.
Figure 15:
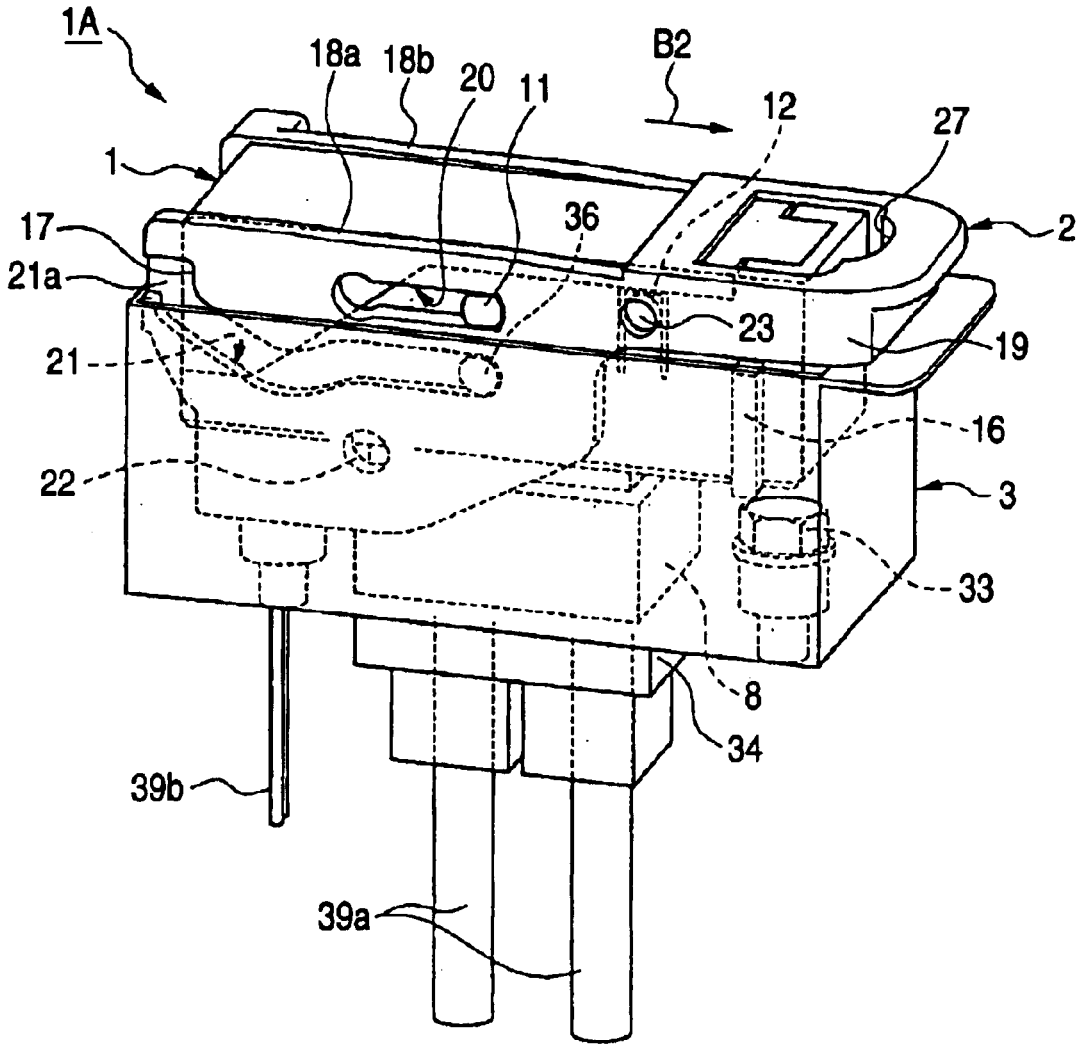
FIG. 15 illustrates the embodiment of the invention and is a perspective view showing a state in which an operation of attaching the first connector housing to the second connector housing is completed.
Figure 16A:
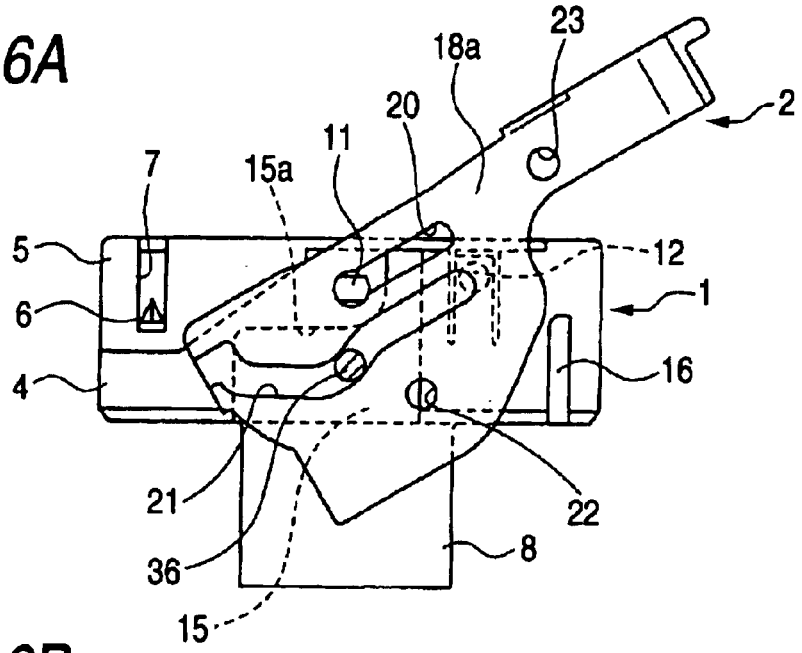
FIGS. 16A, 16B, and 16C illustrate the embodiment of the invention.
Figure 16B:
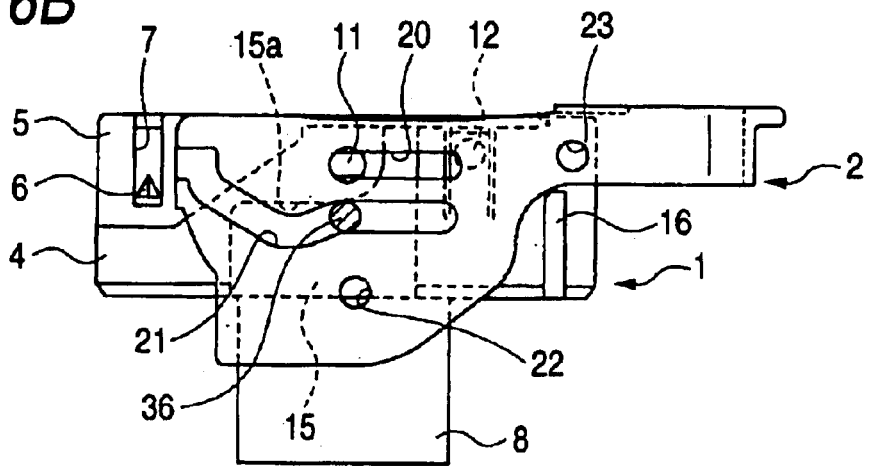
Figure 16C:
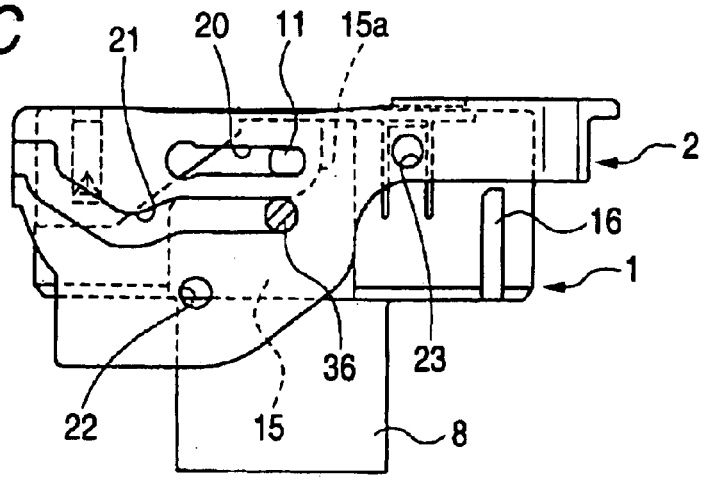
Figure 17A:
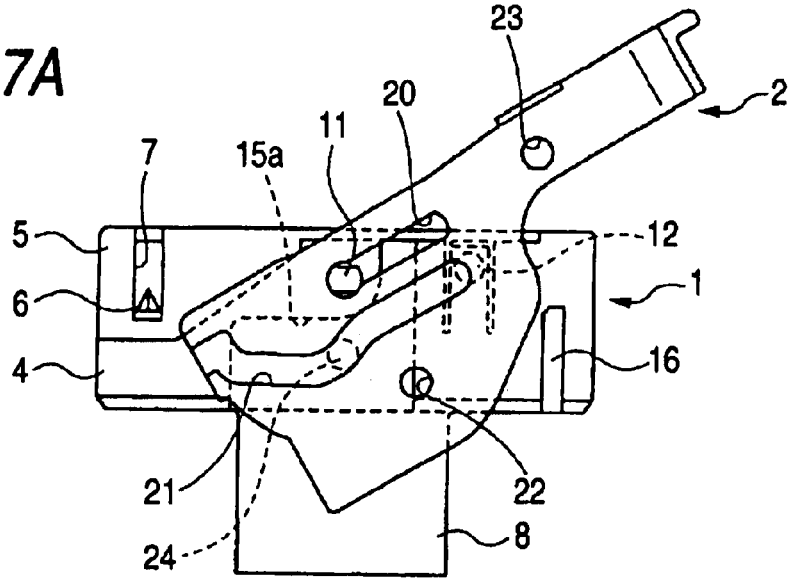
FIGS. 17A, 17B, and 17C illustrate the embodiment of the invention.
Figure 17B:
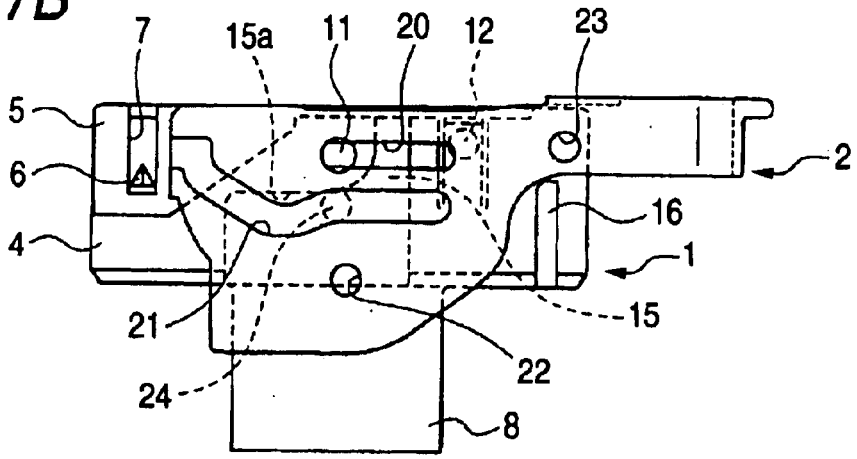
Figure 17C:
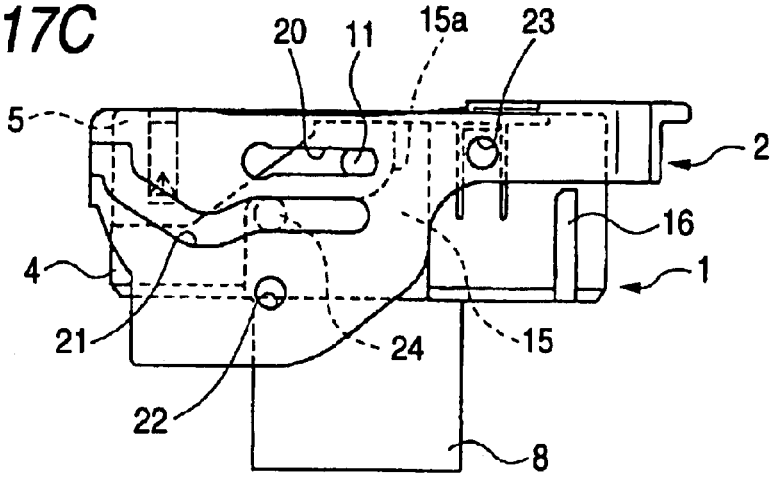
Figure 18A:
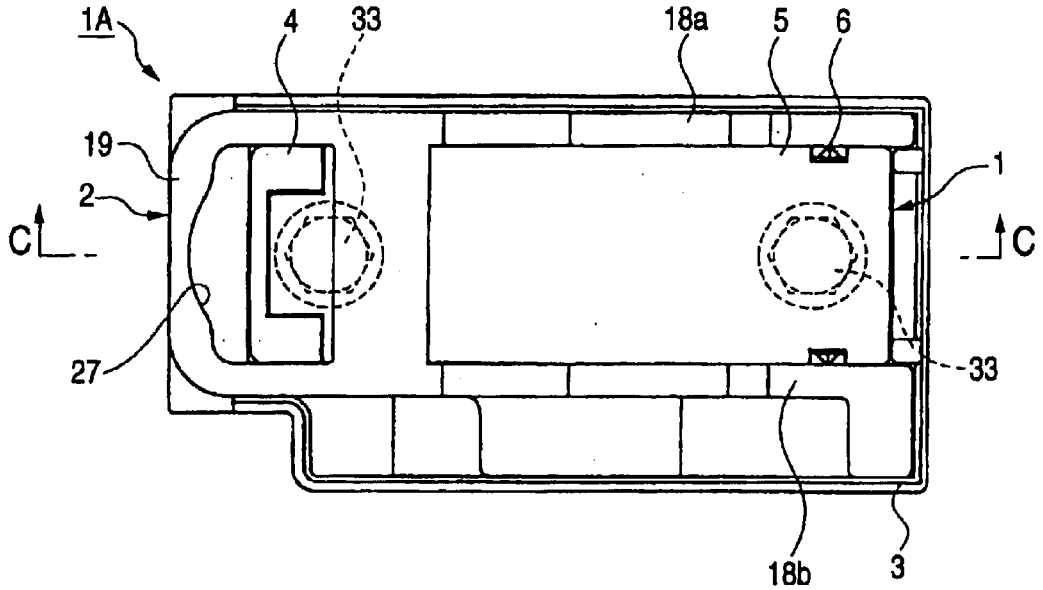
FIGS. 18A and 18B illustrate the embodiment of the invention.
Figure 18B:
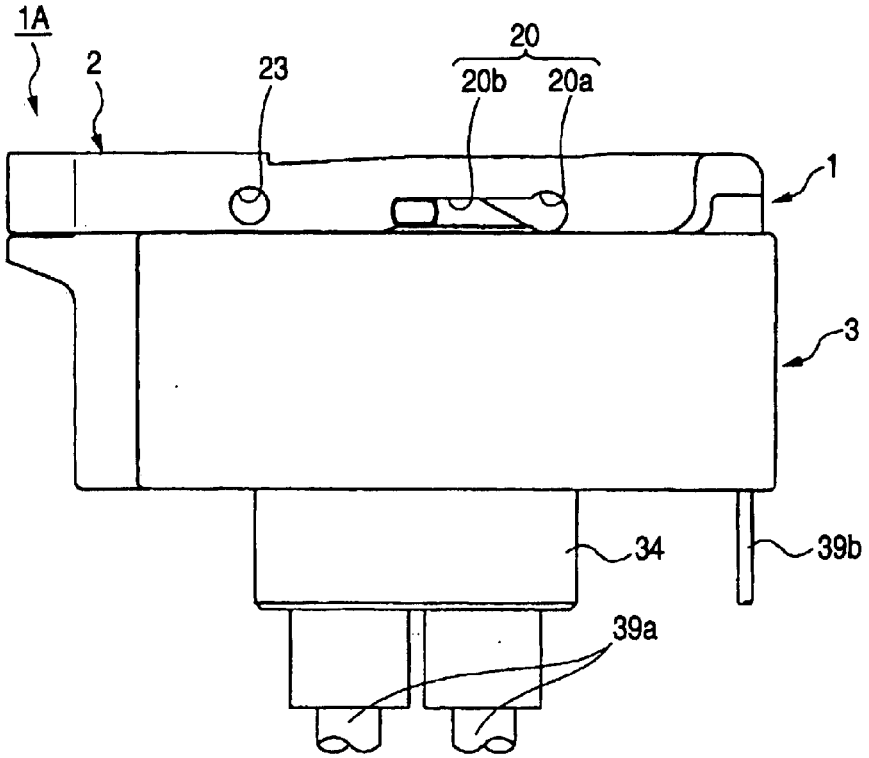
Figure 19:
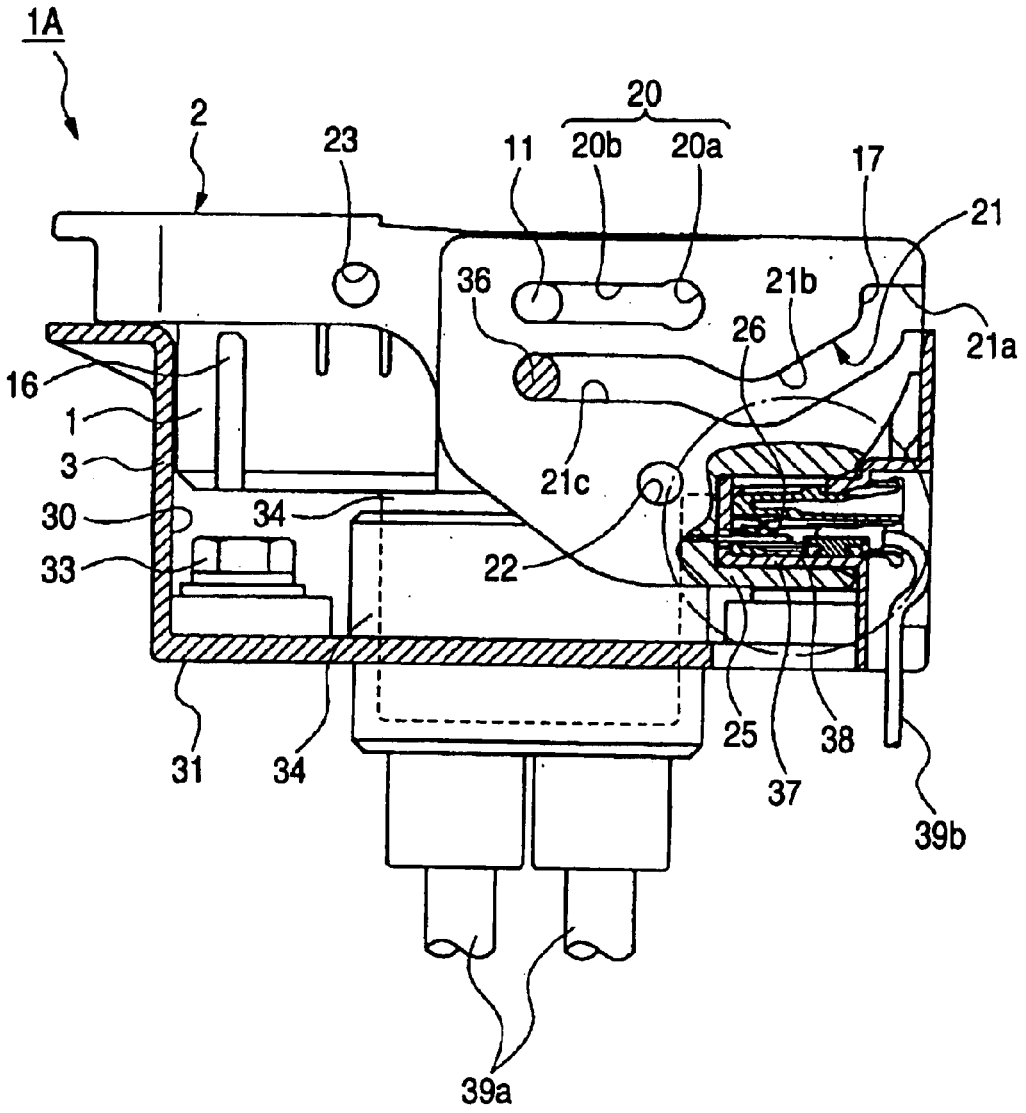
FIG. 19 illustrates the embodiment of the invention and is a sectional view showing a state in which the attachment of the one of the connector housing to the second connector housing is completed.
Figure 20:
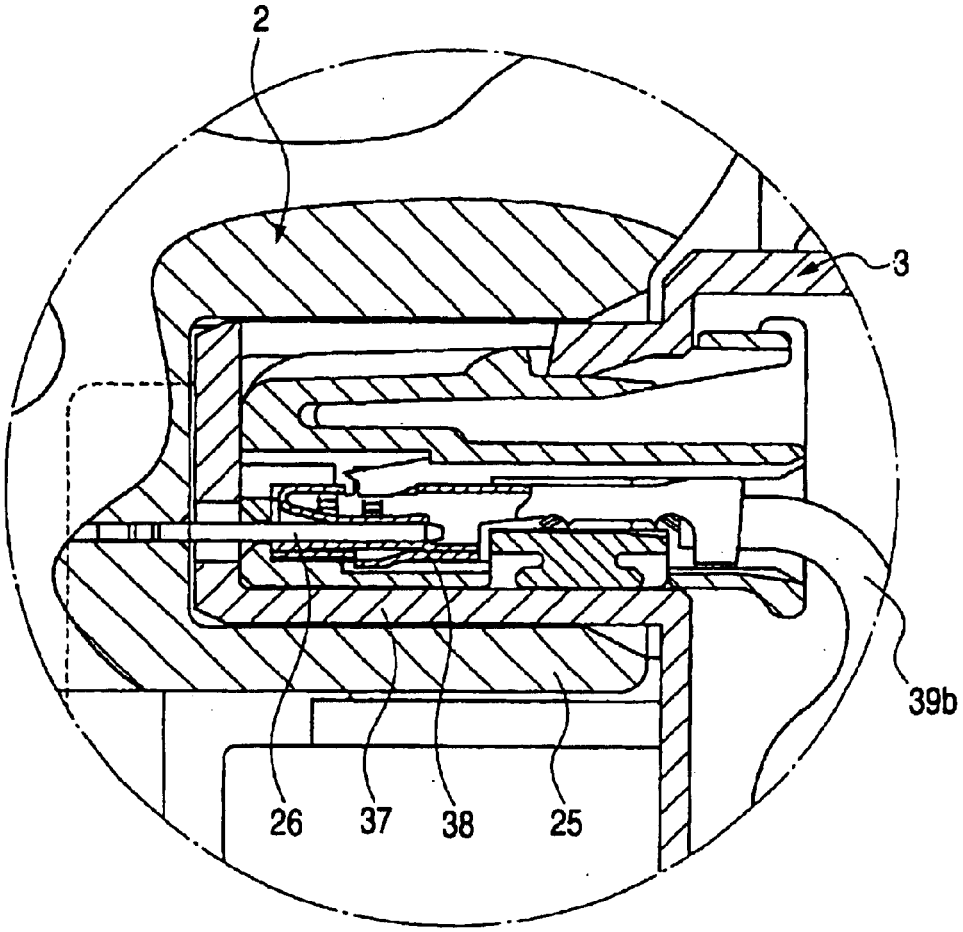
FIG. 20 illustrates the embodiment of the invention and is an enlarged view of a primary part of FIG. 19.

Next, an operation of the lever fitting type power circuit breaking apparatus is described hereinbelow with reference to FIGS. 10 to 21. FIG. 10 is a perspective view showing a state in which the first connector housing 1 is not attached to the second connector housing 3 yet. FIG. 11 is a perspective view showing a state in which the first and second connector housings are placed at a connector temporary-fitting position in a process of attaching the first connector housing 1 to the other connector 3 and in which the lever 2 is placed at a rotation start position. FIG. 12 is a partly broken front view showing the same state. FIG. 13 is a sectional view showing the same state by omitting the lever 2. FIG. 14 is a perspective view showing a state in which the first and second connector housings are placed at a position in a process of attaching the first connector housing 1 to the other connector 3 and in which the lever 2 is placed at a rotation completion position. FIG. 15 is a perspective view showing a state in which an operation of attaching the first connector housing 1 to the second connector housing 3 is completed. FIG. 16A is a front view illustrating a process of movement of the cam pin 3 when the first connector housing 1 is attached to the second connector housing 3, and also illustrating a state in which the lever 2 is placed between the rotation start position and the rotation completion position. FIG. 16B is a front view similarly illustrating the process of movement of the cam pin 36 and also illustrating a state in which the lever 2 is placed at the rotation completion position. FIG. 16C is a front view similarly illustrating the process of movement of the cam pin 3 and also illustrating a state in which the lever 2 is placed at a fitting completion position. FIG. 17A is a front view illustrating a process of movement of a lever locus correction guide pin 24 when the first connector housing 1 is attached to the second connector housing 3, and also illustrating a state in which the lever 2 is placed between the rotation start position and the rotation completion position. FIG. 17B is a front view similarly illustrating the process of movement of the lever locus correction guide pin 24 and also illustrating a state in which the lever 2 is placed at the rotation completion position. FIG. 17C is a front view similarly illustrating the process of movement of the lever locus correction guide pin 24 and also illustrating a state in which the lever 2 is placed at the fitting completion position. FIG. 18A is a plan view illustrating a state in which the attachment of the first connector housing 1 to the second connector housing 3 is completed. FIG. 18B is a front view illustrating the same state. FIG. 19 is a sectional view showing the same state. FIG. 20 is an enlarged view of a primary part of FIG. 19. FIG. 21 is a sectional view taken along line C—C of FIG. 18A.

First, an operation of putting the power supply circuit D into a continuity state by using the lever fitting type power supply circuit breaking apparatus 1A. As illustrated in FIG. 10, the lever 2 is set at the rotation start position (that is, the movement start position), and the one of the connector housing 1 is inserted into the mounting space 30 in the second connector housing 3 from thereabove. Then, the terminal hood portion 8 of the one of the connector housing 1 is inserted into the terminal hood accommodating portion 34 of the second connector housing 3 being fitted thereinto. Moreover, the pair of cam pins 36 and 36 of the second connector housing 3 are inserted into the pair of cam grooves 21 and 21 of the lever 2. Furthermore, as illustrated in FIGS. 11 and 12, the pair of cam pins 36 and 36 come into the opening portions 21*a* of the pair of cam grooves 21 and 21. Then, the pair of cam pins 36 and 36 are caused to abut against the side wall stopper surfaces 17 of the pair of cam grooves 21 and 21. Thus, both the first and second connector housings 1 and 3 are set at the connector temporary-fitting position. At this connector temporary-fitting position, the terminals 9 and 35 of both the first and second connector housings 1 and 3 are not in contact with each other yet.

Next, when the lever 2 is rotated in the direction of an arrow A1 shown in FIGS. 11 and 12, the lever 2 is rotated around the pair of guide pins 11 and 11 from the rotation start position shown in FIG. 11 to the rotation completion position shown in FIG. 14. Further, as illustrated in FIG. 16A, the pair of cam pins 36 and 36 moves in the pair of cam grooves 21 and 21 of the lever 2. Thus, the first connector housing 1 performs approaching movement and gradually comes into the second connector housing 3. Then, this approaching movement brings the terminals 9 and 35 of the first and second connector housings 1 and 3 into a contact state until the lever 2 is moved to the rotation completion position. At the rotation completion position of the lever 2, both the first and second connector housings 1 and 3 are placed at the connector fitting position.

Subsequently, when the lever 2 is caused to slide in the direction of an arrow B1 shown in FIG. 14, the pair of guide pins 11 and 11 slide in the pair of guide grooves 20 and 20, respectively. As illustrated in FIGS. 16B and 16C, the pair of cam pins 36 and 36 of the second connector housing 3 perform sliding movement in the pair of cam grooves 21 and 21. Thus, the lever 2 performs sliding movement (or rectilinear movement) from the rotation completion position of FIG. 14 to the fitting completion position of FIG. 15. This sliding movement causes the fitting detection male terminals 26 of the lever 2 to be in contact with the pair of fitting detection female terminals 38 and 38 of the second connector housing 3 until the lever 2 is placed at the fitting completion position. Further, when the fitting detection switch SW2 is turned on, the relay circuit 42 is then turned on. The power supply circuit D is not put into a continuity state until then.

Next, an operation of putting the power supply circuit D, which has been in a continuity state, into a non-continuity state (that is, an operation of causing power supply interruption) by using the lever fitting type power supply circuit breaking apparatus 1A. When the lever 2 having been in a state shown in FIG. 15 is caused to slide in the direction of an arrow B2 shown in FIG. 15, the pair of guide pins 11 and 11 slide in the guide grooves 20 and 20 of the lever 2. Moreover, the pair of cam pins 36 and 36 of the second connector housing 3 perform sliding movement in the pair of cam grooves 21 and 21 of the lever 2. Thus, the lever 2 performs sliding movement from the fitting completion position shown in FIG. 15 to the rotation completion position shown in FIG. 14. This sliding movement causes the fitting detection male terminals 26 of the lever 2 to go away from the pair of fitting detection female terminals 38 and 38 of the second connector housing 3 and to be out of contact therewith until the lever 2 is placed at the rotation completion position. Then, when the fitting detection switch SW2 is turned off, the relay circuit 42 is turned off. At that time, the power supply circuit D is already in a non-continuity state.

Subsequently, when the lever 2 is rotated in the direction of an arrow A2 shown in FIG. 14, the lever 2 is turned around the pair of guide pins 11 and 11 from the rotation completion position shown in FIG. 14 to the rotation start position (that is, the movement start position) shown in FIGS. 11 and 12. Further, the pair of cam pins 36 and 36 of the second connector housing 3 moves in the pair of cam grooves 21 and 21 of the lever 2. Thus, the first connector housing 1 is gradually and upwardly drawn out to a place above the second connector housing 3 by performing receding movement. Furthermore, this receding movement causes the terminals 9 and 35 of both the first and second connector housings 1 and 3 to be put in a noncontact state until the lever 2 is placed at the rotation start position. At the rotation start position of the lever 2, both the first and second connector housings 1 and 3 are placed at the connector temporary-fitting position.

Incidentally, in the case that the first connector housing 1 is completely detached from the second connector housing 3, it is sufficient to take the first connector housing 1 out of the second connector housing 3 from thereabove.

As above described, in the case of this lever fitting type power supply breaking apparatus 1A, in the process in which the lever 2 performs rotating movement from the rotation start position (that is, the movement start position) to the rotation completion position, the terminals 9 and 35 of both the first and second connector housings 1 and 3 are put into a contact state. Thus, the power switch SW1 is turned on, while the power supply circuit D is not conducted yet. Further, in the process in which the lever 2 performs sliding movement (that is, rectilinear movement) from the rotation completion position to the fitting completion position, the fitting detection switch SW2 is turned on. Thus, the relay circuit 42 is turned on. The power supply circuit D is not conducted until then. Consequently, the power supply circuit D can be prevented from being put into a conducted state halfway in the operation of the lever 2. Therefore, it is properly recognized that the operation of the lever 2 is not completed, and that thus the power supply circuit D is not conducted yet. An occurrence of an accident can be prevented.

Furthermore, when the state of the power supply circuit D is changed from a continuity state to a non-continuity state, the fitting detection switch SW2 is turned on in the process in which the lever 2 undergoes rectilinear movement from the fitting completion position to the rotation completion position. Consequently, the relay circuit 42 is turned off, so that the power supply circuit D is put into a non-continuity state. Meanwhile, in the process in which the lever 2 performs rotating movement from the rotation completion position to the rotation start position, the power switch SW1 constituted by the terminals 9 and 35 of both the first and second connector housings 1 and 3 is put into an open state. There is a time lag between the turning-off of the power supply circuit D and the opening of the power switch SW1 constituted by the terminals 9 and 35 of both the first and second connector housings 1 and 3. Thus, a sufficient discharge time can be ensured. Consequently, an occurrence of arc discharge between the terminals 9 and 36 of both the first and second connector housings 1 and 3 can be prevented.

In brief, the operation of conducting the power supply circuit D consists of two actions, that is, a rotating operation and a sliding operation. The power supply circuit D is conducted by the latter action, that is, the sliding operation. Further, the operation of putting the power supply circuit D into a non-continuity state consists of the two actions, the execution sequence of which is reversed, as compared with that in the case of the operation of conducting the circuit D. The power supply circuit D is turned off by the former action, that is, the sliding operation. Then, the power switch SW1 constituted by the terminals 9 and 35 of both the first and second connector housings 1 and 3 is turned off later by the subsequent action, that is, the rotating operation. Thus, a sufficient discharge time can be secured.

Furthermore, at the connector temporary-fitting position shown in FIGS. 11 to 13, the distance d between the terminals 9 and 35 of both the first and second connector housings 1 and 3 is set at 1.4 mm. Thus, the terminals 9 and 35 of both the first and second connector housings 1 and 3 are apart from each other by a distance at which no arc discharge occurs therebetween. Therefore, when the lever 2 is placed at the movement start position and both the first and second connector housings 1 and 3 are at the connector temporary-fitting position, the terminals 9 and 35 are not conducted. Moreover, there is no fear of occurrence of arc discharge. Consequently, the safety of an operator can sufficiently be ensured.

Further, in the aforementioned embodiment, the movement of the lever 2 includes rotating movement between the rotation start position (that is, the movement start position) and the rotation completion position, during which the terminals 9 and 35 of both the first and second connector housings 1 and 3 are brought into contact with each other or out of contact with each other, and rectilinear movement between the rotation completion position and the fitting completion position, during which the fitting detection switch SW2 is turned on and off. In the lever fitting type power supply circuit breaking apparatus 1A in which the relay circuit 42, which is turned on and off by the fitting detection switch SW2, and the power switch SW1 constituted by the terminals 9 and 35 of both the connector housing 1 are connected in series to the power supply circuit D, even when the relay circuit 42 is not normally turned off owing to failures of the fitting detection switch SW2 and the relay circuit 42 in the operating process in which the lever 2 is rotated from the fitting completion position to the rotation completion position, the terminals 9 and 35 of both the first and second connector housings 1 and 3 are apart from each other by a distance (which is equal to or more than 0.5 mm) at which arc discharge therebetween cannot occur. Therefore, even when the relay circuit 42 is in a normally conducted state owing to breakdowns of electric circuits, such as the fitting detection switch SW2 and the relay circuit 42, the power supply circuit D can be interrupted only by operating the lever 2. The safety of an operator can sufficiently be ensured.

Furthermore, although in the aforementioned embodiment, the distance (or gap) d between the terminals 9 and 35 of both the first and second connector housings 1 and 3 is set at 1.4 mm when the first and second connector housings 1 and 3 are placed at the connector temporary-fitting position. However, it is sufficient to set the distance d so that the terminals 9 and 35 are apart from each other by a distance that is equal to or more than 0.5 mm. In the case that the distance d is equal to or more than 0.5 mm, even when the power supply circuit breaking apparatus of the invention is applied to the power supply circuit D for use in a high-voltage and large-current circuit, arc discharge between the terminals 9 and 35 of both the first and second connector housings 1 and 3 can reliably be prevented.

Furthermore, in the case of the aforementioned embodiment, when the first and second connector housings 1 and 3 are at the fitting completion position, the sliding movement of the lever 2 can be operated only by a single finger inserted in the finger insertion hole 27. Thus, during an operation of performing sliding movement of the lever 2 from the fitting completion position to the rotation completion position, an operator has to operate the lever 2 by using a single finger. Therefore, there is necessity for changing the finger, which is used for operating the lever, in the subsequent rotating operation the lever 2. Consequently, there is caused a large time lag between the turning-off of the power supply circuit D and the opening of the power switch SW1, which is constituted by the terminals 9 and 35 of the first and second connector housings 1 and 3. Consequently, a sufficient discharge time is ensured. Therefore, an occurrence of arc discharge between the terminals 9 and 35 of both the first and second connector housings 1 and 3 can reliably be prevented.

Figure 22A:
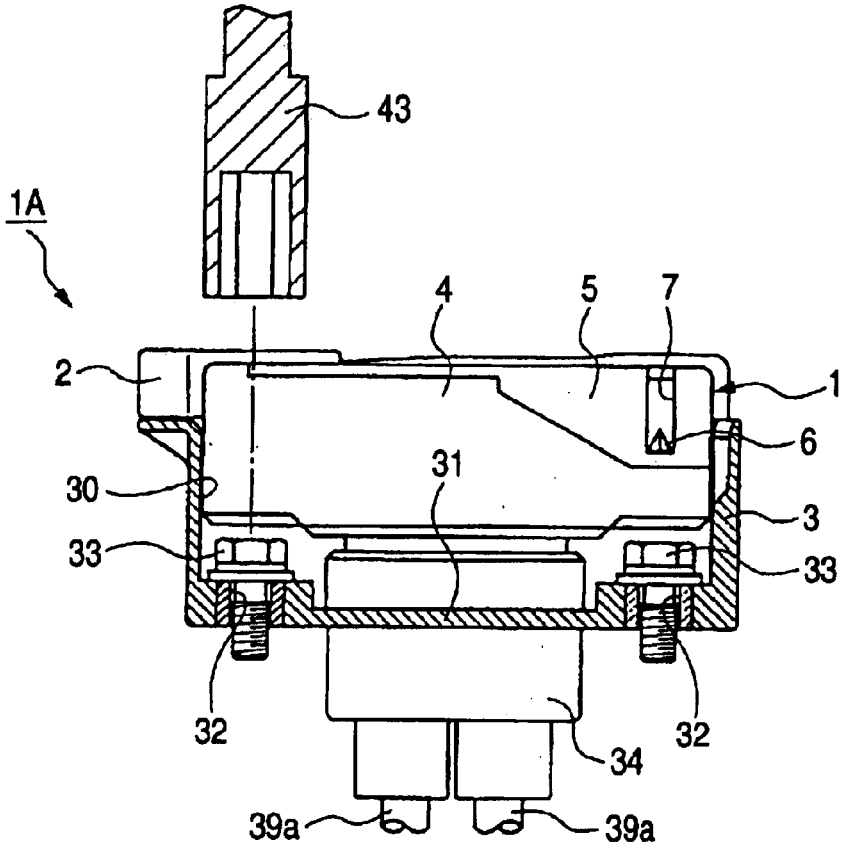
FIGS. 22A and 22B illustrate the embodiment of the invention.
Figure 22B:
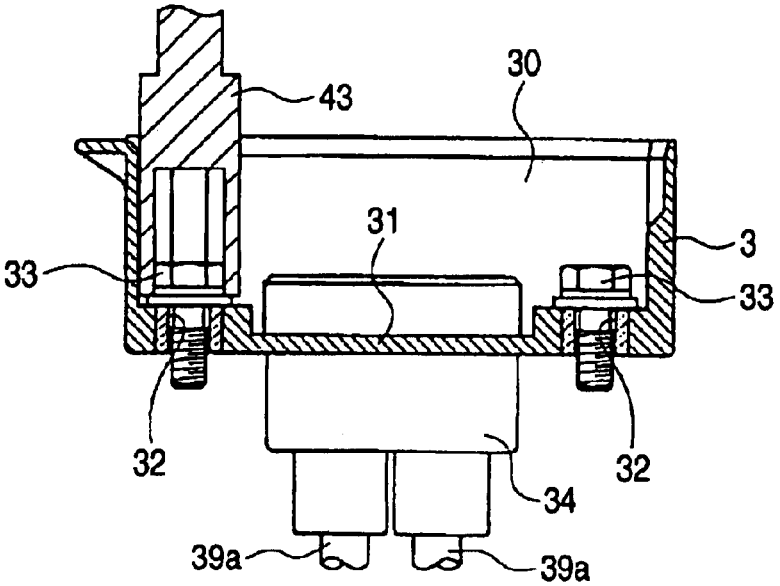
Figure 23:
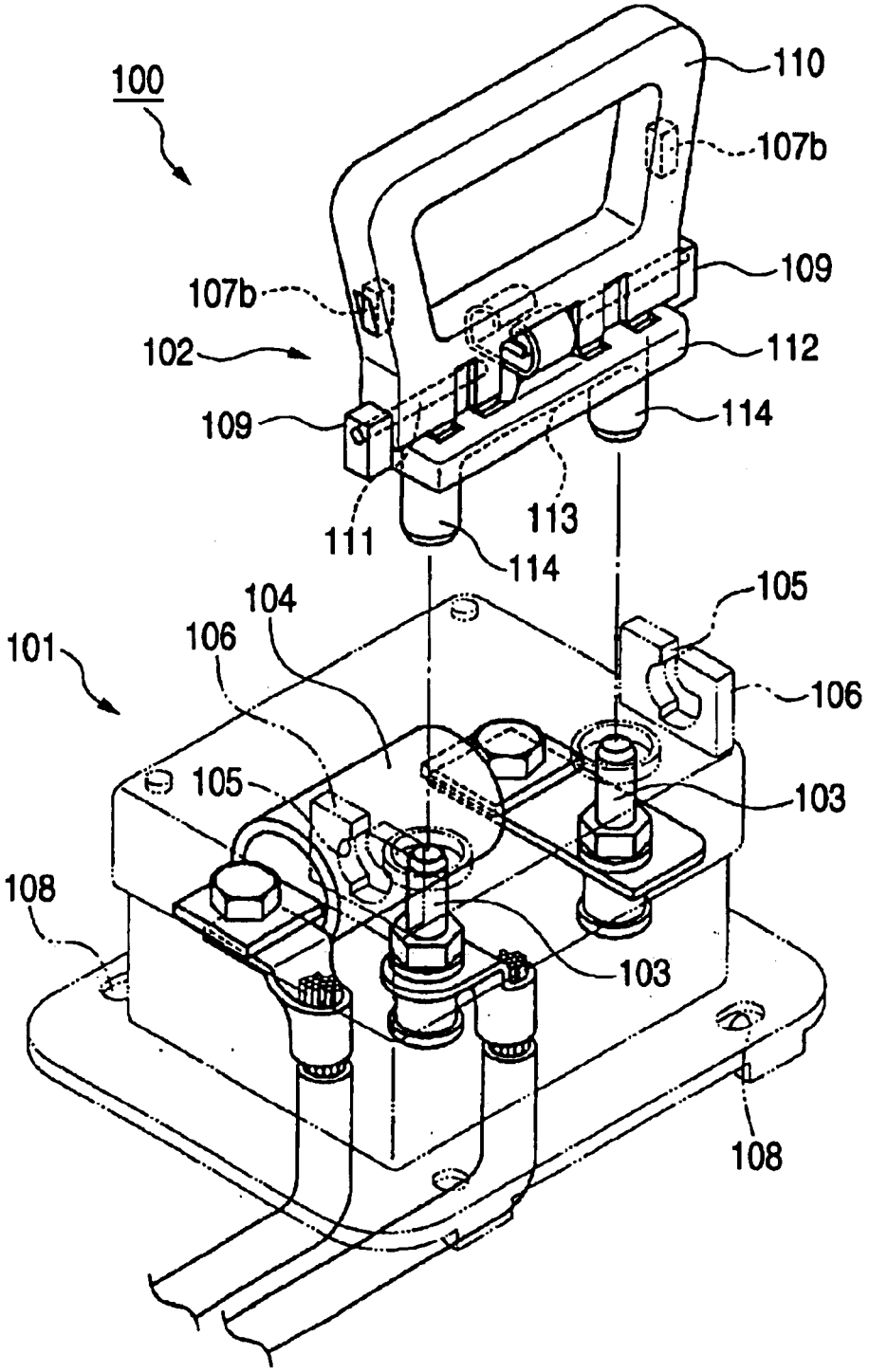
FIG. 23 illustrates a related apparatus and is a perspective view of a power supply circuit breaking apparatus in which a detachable plug is not attached to an apparatus body yet.
Figure 24:
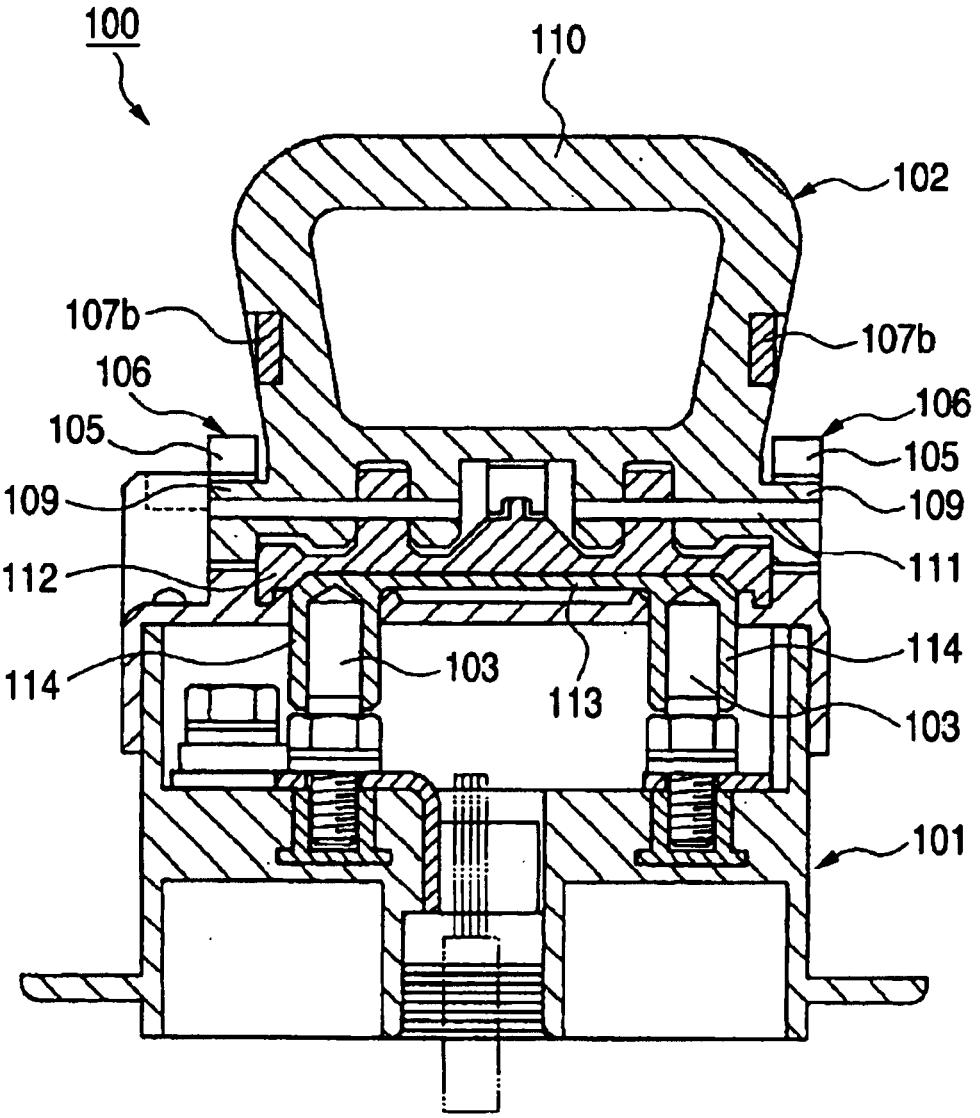
FIG. 24 illustrates the related apparatus and is a sectional view showing a state in which the detachable plug is inserted into the apparatus body.
Figure 25:
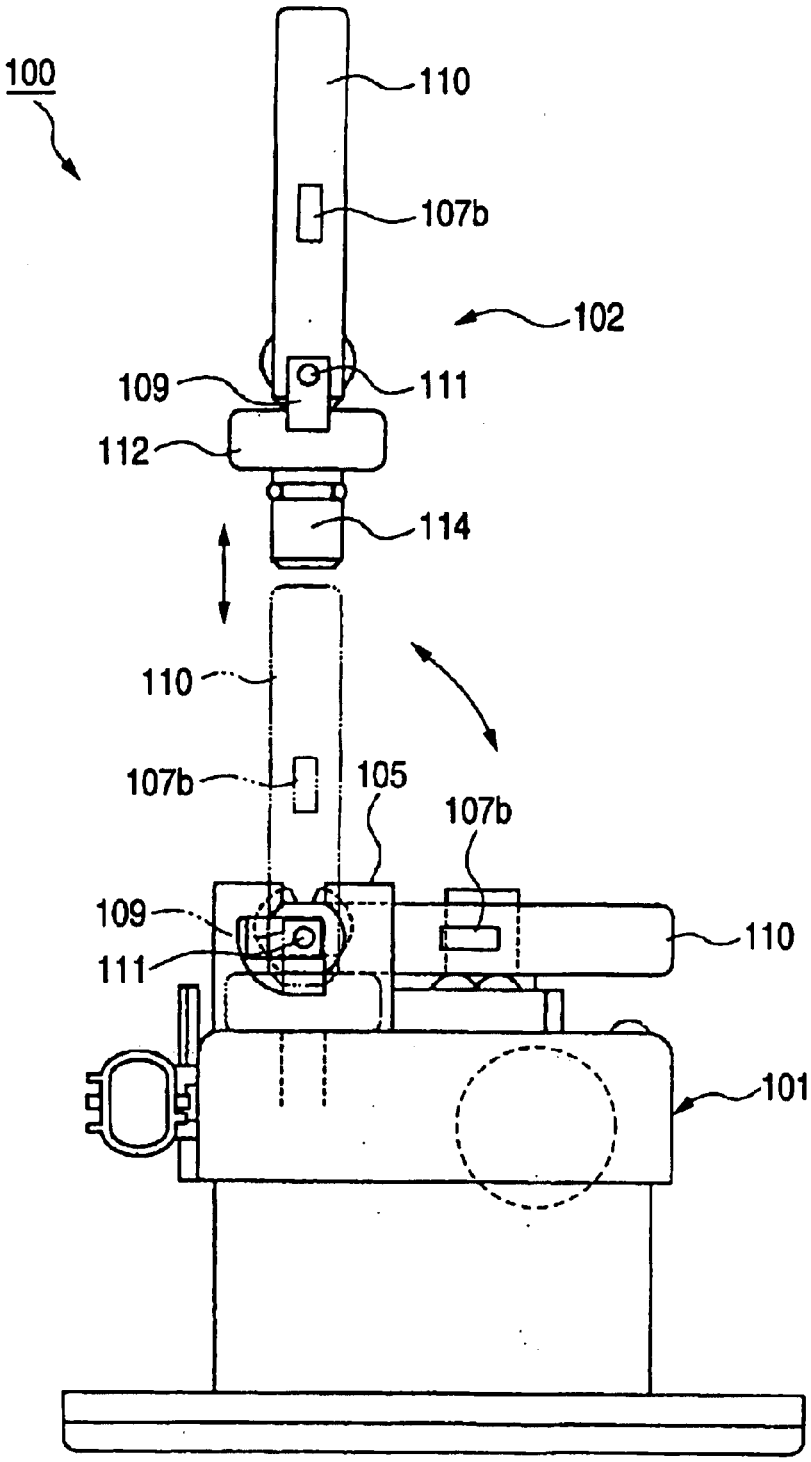
FIG. 25 illustrates the related apparatus and is a side view showing a process of attaching the detachable plug to the apparatus body.
Figure 26:
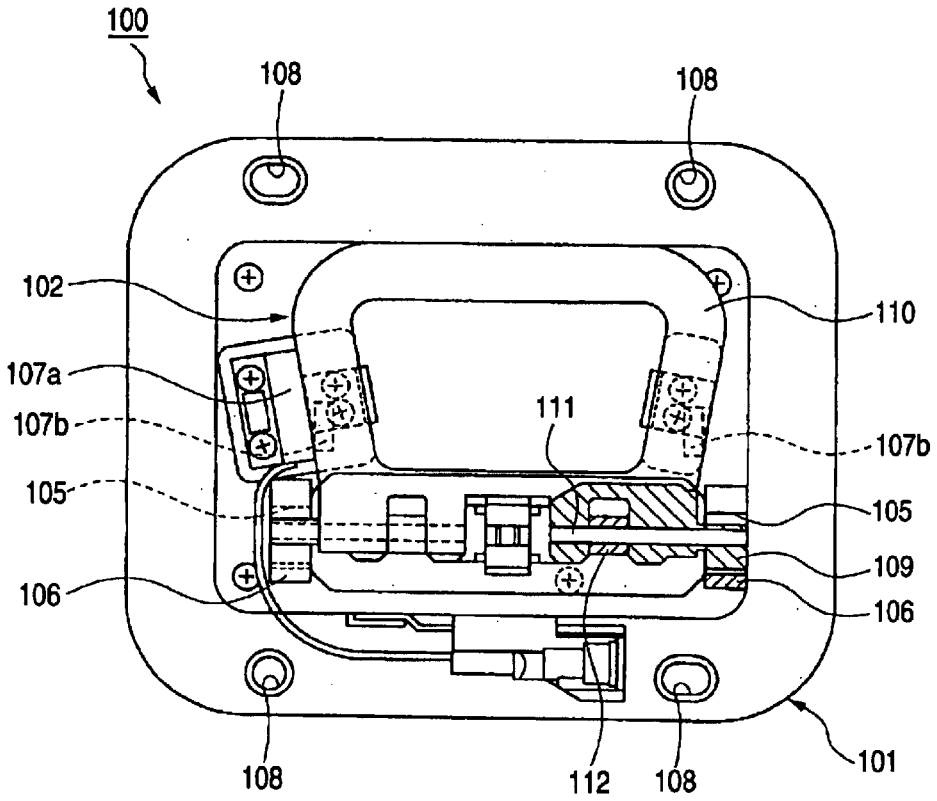
FIG. 26 illustrates the related apparatus and is a plan view showing a state in which the attachment of the detachable plug to the apparatus body is completed.
Figure 27:
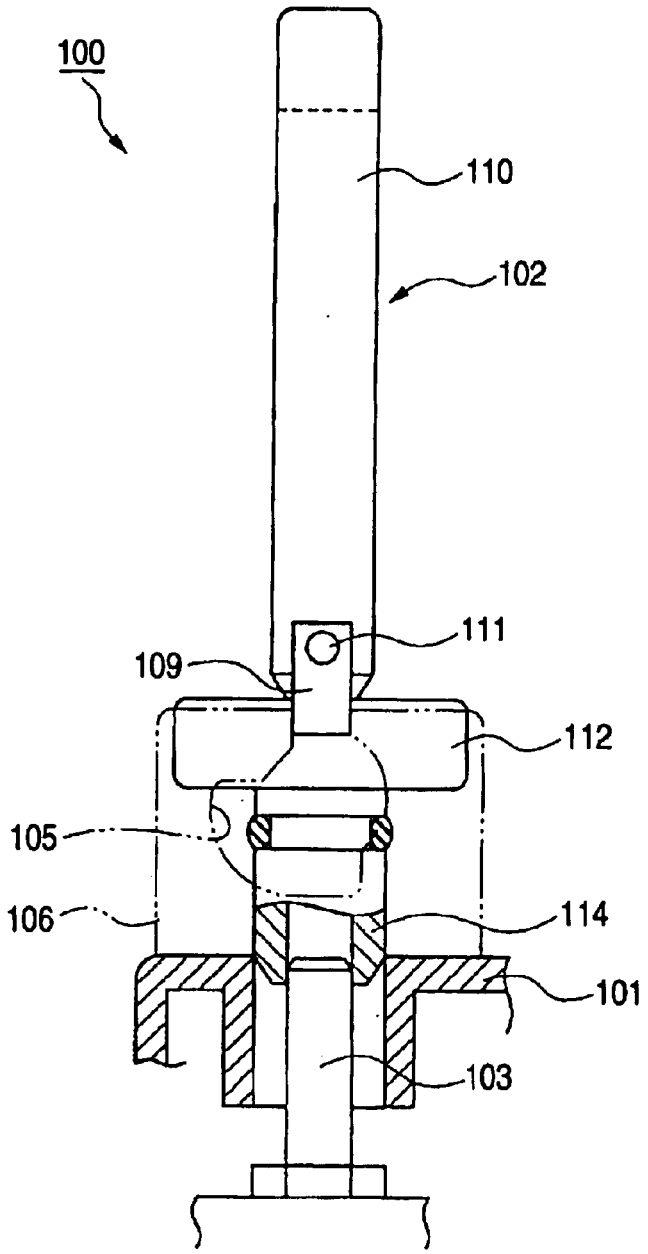
FIG. 27 illustrates the related apparatus and is a side view showing a state in which the detachable plug is incompletely inserted into the apparatus body.
Figure 28:
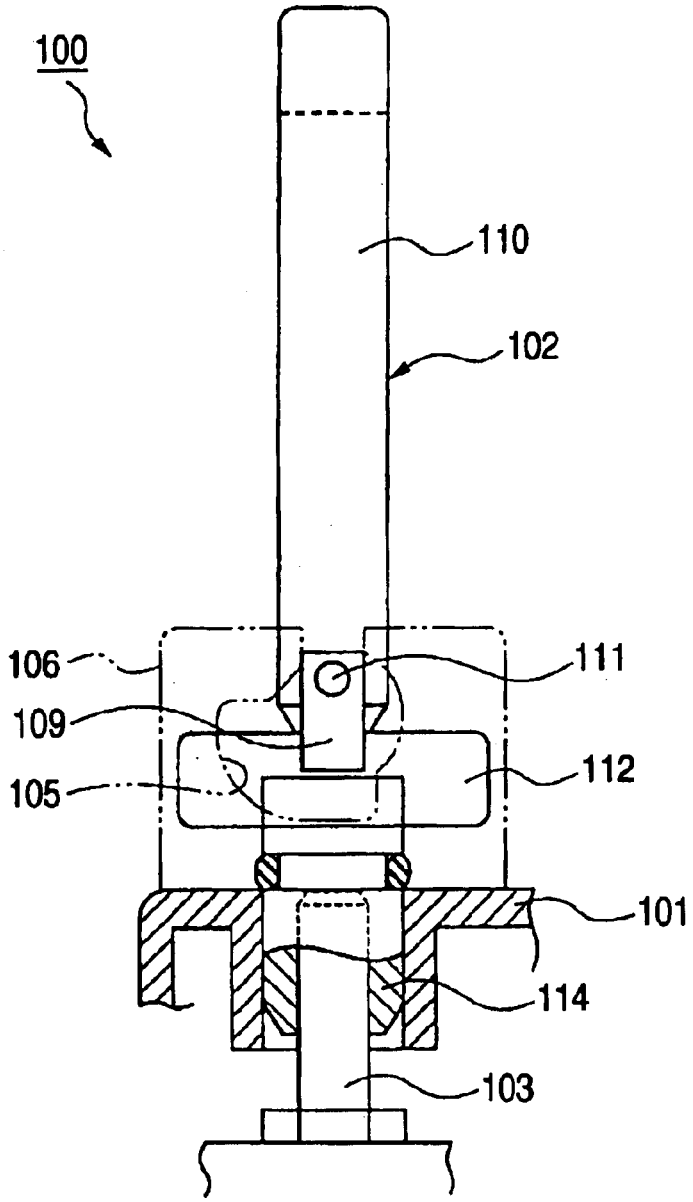
FIG. 28 illustrates the related apparatus and is a side view showing a state in which the operating lever is rotated during the operating lever is incompletely inserted into the apparatus body.
Figure 29:
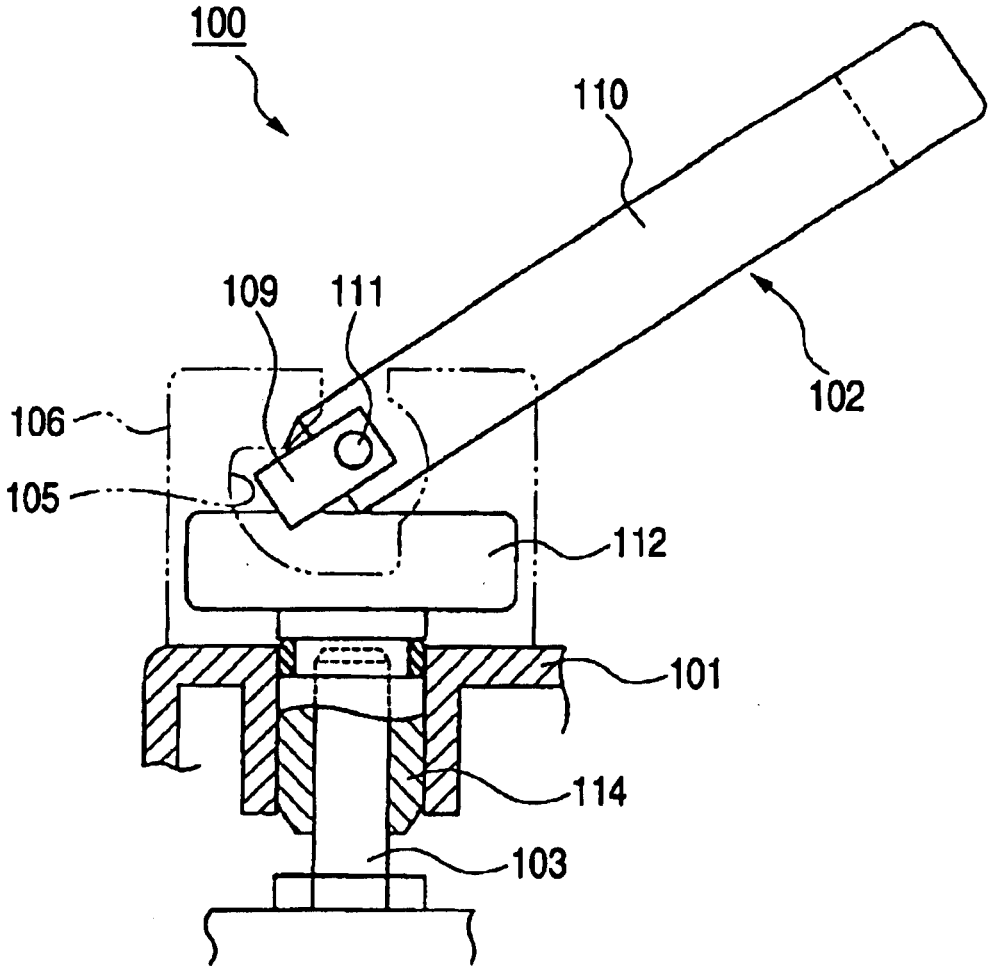
FIG. 29 illustrates the related apparatus and is a side view showing a state in which the operating lever incompletely inserted into the apparatus body is rotated.
Figure 30:
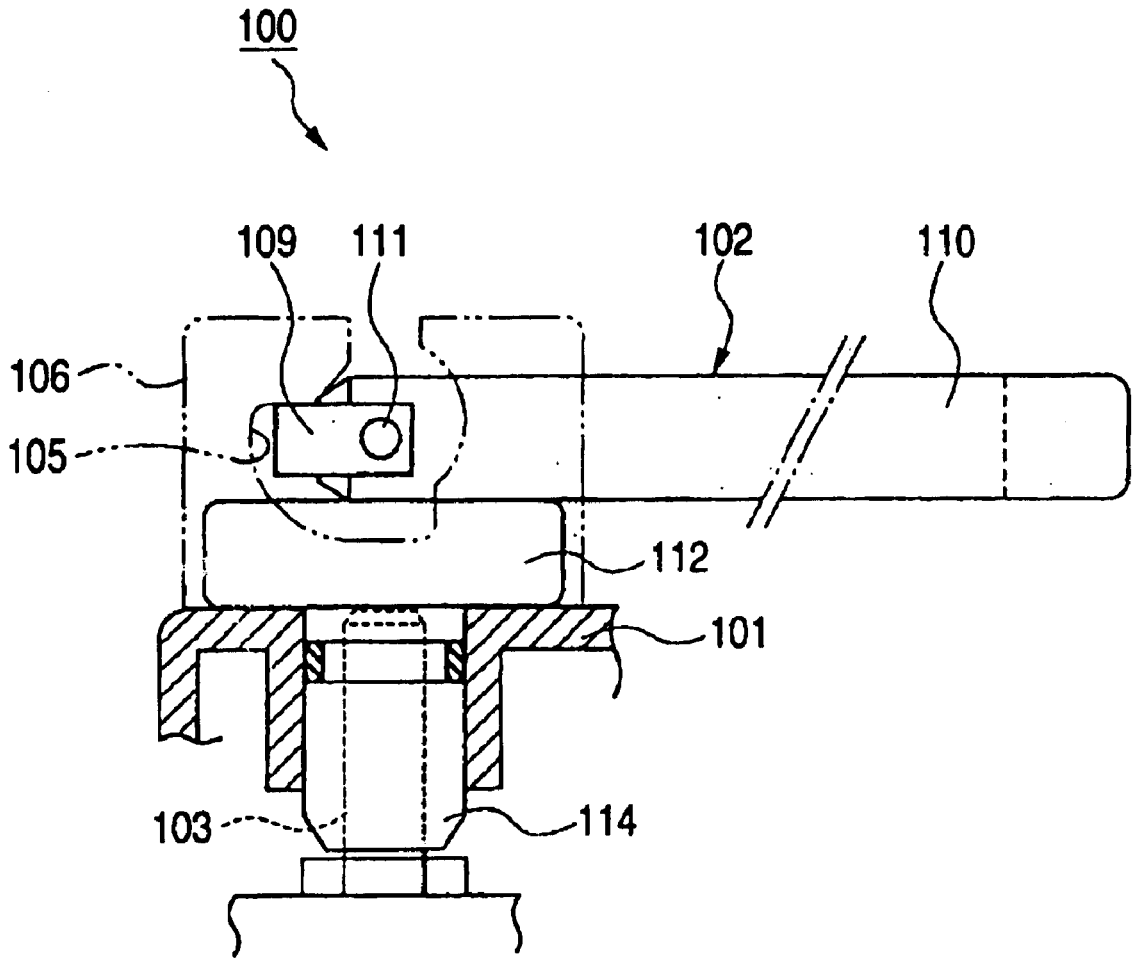
FIG. 30 illustrates the related apparatus and is a side view showing a state in which the operating lever incompletely inserted into the apparatus body is rotated and placed at a falling sidelong position.

Incidentally, FIG. 22A is a sectional view illustrating that a bolt rotating tool 43 cannot be attached to a bolt 33 during the first connector housing 1 is attached to the second connector housing 3. FIG. 22B is a sectional view illustrating a state in which the first connector housing 1 is detached from the second connector housing 3 and in which the bolt rotating tool 43 is attached to the bolt. In the aforementioned embodiment, as illustrated in FIG. 22A, when the first connector housing 1 is attached to the second connector housing 3, the bolt rotating tool 43 cannot be attached to the bolt 33. Further, the second connector housing 3 cannot be detached therefrom. Furthermore, only when the first connector housing 1 is detached from the second connector housing 3, the bolt rotating tool 43 is attached to the bolt 33. Then, the second connector housing 3 can be detached from the mounting face. Therefore, only when the power supply circuit D is reliably put into a non-continuity state, the second connector housing 3 can be detached from the mounting face. Consequently, the safety of an operator can be ensured.

Furthermore, although the cam grooves 21 are provided in the lever 2 and the cam pins 36 are provided in the second connector housing 3 in the aforementioned embodiment, conversely, the cam grooves 21 may be provided in the second connector housing 3, and the cam pins 36 may be provided in the lever 2. Thus, the flexibility in design is enhanced. Furthermore, although the guide grooves 20 are provided in the lever 2, and the guide pins 11 are provided in the first connector housing 1 in the aforementioned embodiment, conversely, the guide grooves 20 may be provided in the one of the connector housing 1, the guide pins 11 may be provided in the lever 2. Consequently, the flexibility in design may be enhanced.

Furthermore, in the aforementioned embodiment, the lever 2 is provided in the one of the connector housing 1 in such a way as to be able to freely perform rotating movement and rectilinear movement (that is, sliding movement). However, the invention may be applied to the case that the lever 2 is moved from the movement start position to the fitting completion position by performing only rotating movement, similarly as the conventional apparatus, or that the lever 2 is moved from the movement start position to the fitting completion position by performing only rectilinear movement (or sliding movement).

As described above, according to the invention, the distance between the terminals of the first and second connector housings placed at the connector temporary-fitting position, at which terminals of both the first and second connector housings are put into a noncontact state, by causing the first connector housing to perform receding movement to go away from the second connector housing, is set to be equal to or more than 0.5 mm. is set to be equal to or more than 0.5 mm. Thus, during the state in which both the first and second connector housings are placed at the connector temporary-fitting position, the terminals of both the first and second connector housings are not electrically conducted to each other, so that an occurrence of arc discharge is prevented. Thereby, the safety of an operator can be sufficiently ensured.

According to the invention, even when the relay circuit is not normally turned off by breakdowns of the fitting detection switch and the relay circuit in an operating process in which the lever rectilinearly moves from the fitting completion position to the rotation completion position, an occurrence of arc discharge between the terminals of both the first and second connector housings is reliably prevented during the state in which both the first and second connector housings are placed at the connector temporary-fitting position. Therefore, even when the relay circuit is put into a normally conducted state owing to a failure of an electric circuit, such as the fitting detection switch or the relay circuit, the power supply circuit can be interrupted only by operating the lever. Thus, the safety of an operator is sufficiently ensured.

What is claimed is:

1. A lever fitting type power supply circuit breaking apparatus comprising:

a first connector provided with a terminal;

a second connector provided with a terminal;

a lever movably provided on the first connector;

a cam groove provided on one of the lever and the second connector; and a cam pin provided on the other of the lever and the second connector and adapted to be engaged with the cam groove, wherein in a connector temporary-fitting position, the first connector is fitted to the second connector and the terminal of the first connector is separated from the terminal of the second connector, in a connector fitting position, the first connector is fitted to the second connector and the terminal of the first connector is electrically connected to the terminal of the second connector, wherein the cam pin is moved along and guided by the cam groove so as to shift the first and second connector from the connector temporary-fitting position to the connector fitting position as the lever is shifted from a movement start position to a fitting completion position, and wherein the lever performs rectilinear movement so that a fitting detection terminal of the lever is put in contact with a fitting detection terminal of the second connector so as to turn on a relay circuit.

2. The lever fitting type power supply circuit breaking apparatus according to claim 1, wherein in the connector temporary-fitting position, the first connector is fitted to the second connector and the terminal of the first connector is separated from the terminal of the second connector by 0.5 mm or more.

3. A lever fitting type power supply circuit breaking apparatus comprising:

a first connector provided with a terminal;

a second connector provided with a terminal;

a lever movably provided on the first connector;

a cam groove provided on one of the lever and the second connector; and a cam pin provided on the other of the lever and the second connector and adapted to be engaged with the cam groove, wherein in a connector temporary-fitting position, the first connector is fitted to the second connector and the terminal of the first connector is separated from the terminal of the second connector, in a connector fitting position, the first connector is fitted to the second connector and the terminal of the first connector is electrically connected to the terminal of the second connector, wherein the cam pin is moved along and guided by the cam groove so as to shift the first and second connector from the connector temporary-fitting position to the connector fitting position as the lever is shifted from a movement start position to a fitting completion position, and wherein the lever performs rotational movement between the movement start position in which the terminals of the first and second connectors are separated from each other and a rotation completion position in which the terminals of the first and second connectors are brought in electrical contact with each other, and rectilinear movement between the rotation completion position in which a fitting detection switch is in an off state and the fitting completion position in which the fitting detection switch is in an on state, and wherein a power supply circuit is connected in series to a relay circuit which is turned on and off by the fitting detection switch, and a power switch comprising the terminals of the first and second connector housings.

4. The lever fitting type power supply circuit breaking apparatus according to claim 3, wherein in the connector temporary-fitting position, the first connector is fitted to the second connector and the terminal of the first connector is separated from the terminal of the second connector by 0.5 mm or more.

* * * * *